US008544432B2

(12) United States Patent
Tadokoro et al.

(10) Patent No.: US 8,544,432 B2
(45) Date of Patent: Oct. 1, 2013

(54) VARIABLE VALVE ACTUATION APPARATUS OF INTERNAL COMBUSTION ENGINE

(75) Inventors: Ryo Tadokoro, Atsugi (JP); Atsushi Yamanaka, Atsugi (JP); Shinichi Kawada, Isehara (JP)

(73) Assignee: Hitachi Automotive Systems, Ltd., Ibaraki (JP)

( * ) Notice: Subject to any disclaimer, the term of this patent is extended or adjusted under 35 U.S.C. 154(b) by 272 days.

(21) Appl. No.: 13/078,023

(22) Filed: Apr. 1, 2011

(65) Prior Publication Data

US 2011/0265747 A1 Nov. 3, 2011

(30) Foreign Application Priority Data

Apr. 28, 2010 (JP) ..... 2010-103385

(51) Int. Cl.
*F01L 1/34* (2006.01)

(52) U.S. Cl.
USPC ..... 123/90.17; 123/90.15

(58) Field of Classification Search
USPC ..... 123/90.17, 90.15, 90.31
See application file for complete search history.

(56) References Cited

U.S. PATENT DOCUMENTS

| | | | | |
|---|---|---|---|---|
| 5,352,163 | A | 10/1994 | Minegishi et al. | |
| 5,427,064 | A * | 6/1995 | Murata et al. | 123/90.16 |
| 2009/0199801 | A1 | 8/2009 | Imai et al. | |

FOREIGN PATENT DOCUMENTS

| | | |
|---|---|---|
| JP | 5-296300 | 11/1993 |
| JP | 2009-185785 | 8/2009 |
| JP | 2010-084716 | 4/2010 |
| JP | 2010-090889 | 4/2010 |
| WO | WO 2010018821 A1 * | 2/2010 |

* cited by examiner

*Primary Examiner* — Zelalem Eshete
(74) *Attorney, Agent, or Firm* — Antonelli, Terry, Stout & Kraus, LLP.

(57) ABSTRACT

In a variable valve actuation apparatus with a speed reducer between a timing sprocket and a camshaft for changing a phase of the camshaft relative to the sprocket, while reducing normal-rotation/reverse-rotation of an electric motor, the speed reducer includes an eccentric rotation member connected to an output shaft of the motor, an annular member connected to the sprocket, a plurality of rollers installed between an inner toothed portion of the annular member and an outer peripheral surface of the eccentric rotation member, and a cage connected to the camshaft for circumferentially partitioning the respective rollers, while permitting a radial displacement of each roller. Depending on a dimension of a clearance space between the eccentric rotation member and the annular member, a suitable one of a plurality of roller sets, each having a different outside diameter, is selected, and then the selected rollers are installed.

16 Claims, 12 Drawing Sheets

VARIABLE VALVE ACTUATION APPARATUS OF INTERNAL COMBUSTION ENGINE

TECHNICAL FIELD

The present invention relates to a variable valve actuation apparatus configured to variably control engine valve characteristics, such as valve closure timing, valve open timing, and working angle of an engine valve (intake and/or exhaust valves), by means of an electric-motor-driven converter.

BACKGROUND ART

In recent years, there have been proposed and developed various variable valve actuation devices, for example, variable valve timing control devices designed to enhance their control stability and control responsiveness by the use of an electric-motor-driven converter. One such motor-driven converter equipped variable valve actuation device has been disclosed in Japanese Patent Provisional Publication No. 2009-185785 (hereinafter is referred to as "JP2009-185785"), corresponding to U.S. patent application Publication No. US2009/0199801 A1, published on Aug. 13, 2009. In the variable valve timing control device disclosed in JP2009-185785, in order to variably control engine valve timing depending on an engine operating condition, a relative angular phase between a camshaft and a timing sprocket, which sprocket rotates in synchronism with rotation of an engine crankshaft, is changed by reducing the rotational speed of the output shaft of the electric motor by means of a speed reducer constructed by a planetary gear drive.

SUMMARY OF THE INVENTION

However, in the variable valve timing control device disclosed in JP2009-185785, a planetary gear drive, including a plurality of gears, concretely, a sun gear and a planet gear meshing each other, is used as a speed reducer. Due to individual differences of the meshing pair of component parts (the sun gear and the planet gear) manufactured, there is an increased tendency for the dimension of the clearance space of the mating portion to be deviated from an allowable clearance range. For instance in the presence of a positive deviation of the clearance space of the mating portion exceeding the allowable clearance range, assume that the mating portion receives alternating torque (positive and negative torque fluctuations) exerted on the camshaft. In such a case, the two opposing faces of the mating portion could be brought into collision-contact with each other. This leads to the occurrence of comparatively great hammering noise.

It is, therefore, in view of the previously-described disadvantages of the prior art, an object of the invention to provide a variable valve actuation apparatus of an internal combustion engine, capable of sufficiently suppressing the occurrence of hammering noise during operation of a speed reducer.

In order to accomplish the aforementioned and other objects of the present invention, a variable valve actuation apparatus of an internal combustion engine configured to vary an operating characteristic of an engine valve permanently biased in a direction closing of the engine valve by a valve spring, by changing an angular position of a second member relative to a first member, comprises an electric motor in which a state of rotation of the electric motor is controlled responsively to a control signal, an eccentric rotation member configured to rotate eccentrically with respect to a center of rotation of an output shaft of the electric motor by torque transmitted from the electric motor, an inner peripheral meshing member integrally connected to one of the first and second members and having an internal toothed portion formed on its inner periphery, a plurality of rolling elements rotatably installed on an outer peripheral surface of the eccentric rotation member and circumferentially arranged substantially at regular intervals, and configured such that a meshing point of the plurality of rolling elements with the inner peripheral meshing member circumferentially shifts by eccentric rotary motion of the eccentric rotation member, and a cage integrally connected to the other member of the first and second members and having a plurality of lugs for circumferentially partitioning the respective rolling elements, while permitting a radial displacement of each of the rolling elements, wherein, depending on a dimension of a clearance space between the outer peripheral surface of the eccentric rotation member and the inner peripheral meshing member, either one of a plurality of rolling-element sets, each having a different rolling-element outside diameter, is selected, and then the rolling elements of the selected rolling-element set are installed on the outer peripheral surface of the eccentric rotation member.

According to another aspect of the invention, a variable valve actuation apparatus of an internal combustion engine configured to vary an operating characteristic of an engine valve permanently biased in a direction closing of the engine valve by a valve spring, by changing an angular position of a second member relative to a first member, comprises an electric motor in which a state of rotation of the electric motor is controlled responsively to a control signal, an eccentric rotation member configured to rotate eccentrically with respect to a center of rotation of an output shaft of the electric motor by torque transmitted from the electric motor, an inner peripheral meshing member integrally connected to one of the first and second members and having an internal toothed portion formed on its inner periphery, a plurality of rolling elements rotatably installed on an outer peripheral surface of the eccentric rotation member and circumferentially arranged substantially at regular intervals, and configured such that a meshing point of the plurality of rolling elements with the inner peripheral meshing member circumferentially shifts by eccentric rotary motion of the eccentric rotation member, and a cage integrally connected to the other member of the first and second members and having a plurality of lugs for circumferentially partitioning the respective rolling elements, while permitting a radial displacement of each of the rolling elements, wherein, depending on a dimension of a clearance space between the outer peripheral surface of the eccentric rotation member and the inner peripheral meshing member, either one of a plurality of eccentric rotation members, each having a different outside diameter, is selectively installed.

According to a further aspect of the invention, a method of manufacturing a variable valve actuation apparatus of an internal combustion engine configured to vary an operating characteristic of an engine valve permanently biased in a direction closing of the engine valve by a valve spring, by changing an angular position of a second member relative to a first member via a speed reducer, said speed reducer including an eccentric rotation member configured to rotate eccentrically with respect to a center of rotation of an output shaft of an electric motor by torque transmitted from the electric motor, an inner peripheral meshing member integrally connected to one of the first and second members and having an internal toothed portion formed on its inner periphery, a plurality of rolling elements rotatably installed on an outer peripheral surface of the eccentric rotation member and circumferentially arranged substantially at regular intervals, and configured such that a meshing point of the plurality of rolling elements with the inner peripheral meshing member circumferentially shifts by eccentric rotary motion of the eccentric rotation member, and a cage integrally connected to the other member of the first and second members and having a plurality of lugs for circumferentially partitioning the respective rolling elements, while permitting a radial displacement of each of the rolling elements, comprises installing the rolling elements, each having a reference outside diameter, into respective spaces partitioned by the lugs of the cage arranged between the outer peripheral surface of the eccentric rotation member and the inner peripheral meshing member, measuring, under a state where the rolling elements, each having the reference outside diameter, have been installed, either one of a radial clearance C1 between an outer peripheral surface of a specified one of the rolling elements, interleaved and deeply engaged in a space defined between the outer peripheral surface of the eccentric rotation member and an inner face of the internal toothed portion of the inner peripheral meshing member, positioned in an eccentric direction of the eccentric rotation member whose geometric center is displaced from the center of rotation of the motor output shaft and the inner face of the internal toothed portion of the inner peripheral meshing member and a radial clearance C2 between the outer peripheral surface of the specified one of the rolling elements, interleaved and deeply engaged in the space defined between the outer peripheral surface of the eccentric rotation member and the inner face of the internal toothed portion of the inner peripheral meshing member, positioned in the eccentric direction of the eccentric rotation member and the outer peripheral surface of the eccentric rotation member, determining, based on a measurement result of the radial clearance, which of a plurality of rolling-element sets, each having a different rolling-element outside diameter, should be selected as a rolling-element set suitable for the measured radial clearance, and reinstalling the rolling elements of the suitably-selected rolling-element set into the respective spaces partitioned by the lugs of the cage, only when the rolling elements, each having the reference outside diameter, are unsuitable for the measured radial clearance.

According to a still further aspect of the invention, a method of manufacturing a variable valve actuation apparatus of an internal combustion engine configured to vary an operating characteristic of an engine valve permanently biased in a direction closing of the engine valve by a valve spring, by changing an angular position of a second member relative to a first member via a speed reducer, said speed reducer including an eccentric rotation member configured to rotate eccentrically with respect to a center of rotation of an output shaft of an electric motor by torque transmitted from the electric motor, an inner peripheral meshing member integrally connected to one of the first and second members and having an internal toothed portion formed on its inner periphery, a plurality of rolling elements rotatably installed on an outer peripheral surface of the eccentric rotation member and circumferentially arranged substantially at regular intervals, and configured such that a meshing point of the plurality of rolling elements with the inner peripheral meshing member circumferentially shifts by eccentric rotary motion of the eccentric rotation member, and a cage integrally connected to the other member of the first and second members and having a plurality of lugs for circumferentially partitioning the respective rolling elements, while permitting a radial displacement of each of the rolling elements, comprises installing the rolling elements into respective spaces partitioned by the lugs of the cage arranged between the outer peripheral surface of the eccentric rotation member having a reference outside diameter and the inner peripheral meshing member, measuring, under a state where the rolling elements have been installed, either one of a radial clearance C1 between an outer peripheral surface of a specified one of the rolling elements, interleaved and deeply engaged in a space defined between the outer peripheral surface of the eccentric rotation member and an inner face of the internal toothed portion of the inner peripheral meshing member, positioned in an eccentric direction of the eccentric rotation member whose geometric center is displaced from the center of rotation of the motor output shaft and the inner face of the internal toothed portion of the inner peripheral meshing member and a radial clearance C2 between the outer peripheral surface of the specified one of the rolling elements, interleaved and deeply engaged in the space defined between the outer peripheral surface of the eccentric rotation member and the inner face of the internal toothed portion of the inner peripheral meshing member, positioned in the eccentric direction of the eccentric rotation member and the outer peripheral surface of the eccentric rotation member, determining, based on a measurement result of the radial clearance, which of a plurality of eccentric rotation members, each having a different outside diameter, should be selected as an eccentric rotation member suitable for the measured radial clearance, and reinstalling the suitably-selected eccentric rotation member, only when the eccentric rotation member having the reference outside diameter is unsuitable for the measured radial clearance.

The other objects and features of this invention will become understood from the following description with reference to the accompanying drawings.

BRIEF DESCRIPTION OF THE DRAWINGS

FIG. 8A is a partially enlarged view illustrating a reference-roller installation state where a reference roller has been installed prior to the clearance adjustment, whereas

DESCRIPTION OF THE PREFERRED EMBODIMENTS

[First Embodiment]

Figure 1:
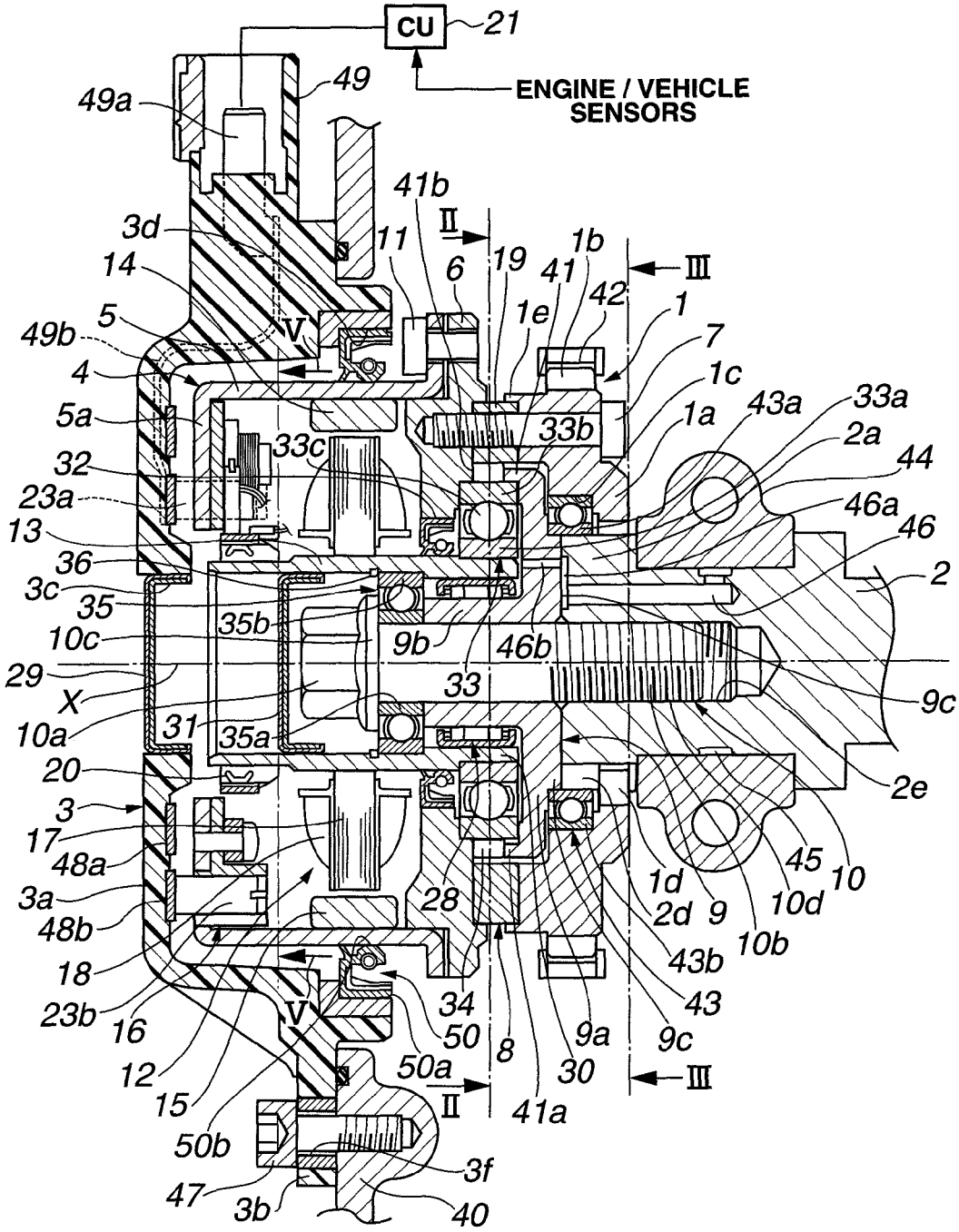
FIG. 1 is a longitudinal cross-sectional view illustrating an embodiment of a variable valve actuation apparatus, namely, a variable valve timing control (VTC) device.

Referring now to the drawings, particularly to FIGS. 1-5, the variable valve actuation apparatus of the embodiment is exemplified in a variable valve timing control (VTC) device of an internal combustion engine. In the shown embodiment, the VTC device is applied to a valve operating system of the intake-valve side of the internal combustion engine. In lieu thereof, the VTC device may be applied to a valve operating system of the exhaust-valve side of the engine.

As shown in FIGS. 1-5, the VTC device of the embodiment is comprised of a timing sprocket 1 (a drive rotary member) that rotates in synchronism with rotation of an engine crankshaft, a camshaft 2 rotatably supported on a cylinder head (an engine body not shown) through camshaft-journal bearings 44 and driven by torque transmitted from timing sprocket 1, a cover member 3 (a stationary member) laid out in front of the timing sprocket 1 and bolted to a chain cover 40, and a phase converter 4 installed between timing sprocket 1 and camshaft 2 for changing a relative angular phase between timing sprocket 1 (a first member) and camshaft 2 (a second member) depending on an engine operating condition. Chain cover 40 is bolted to the cylinder head (a stationary engine body).

Timing sprocket 1 is comprised of an annular sprocket body 1*a*, and a timing gear 1*b*. Sprocket body 1*a* is made of iron-based metal material, and formed with a stepped inner peripheral portion and formed integral with timing gear 1*b*. Timing gear 1*b* receives torque from the crankshaft through a timing chain 42 wound on both a sprocket on the crankshaft and the sprocket 1 on the camshaft. Timing sprocket 1 is rotatably supported by a second ball bearing 43 interleaved between a circular groove 1*c* formed in sprocket body 1*a* and the outer periphery of a thick-wall flanged portion 2*a* integrally formed with the front end of camshaft 2.

Figure 3:
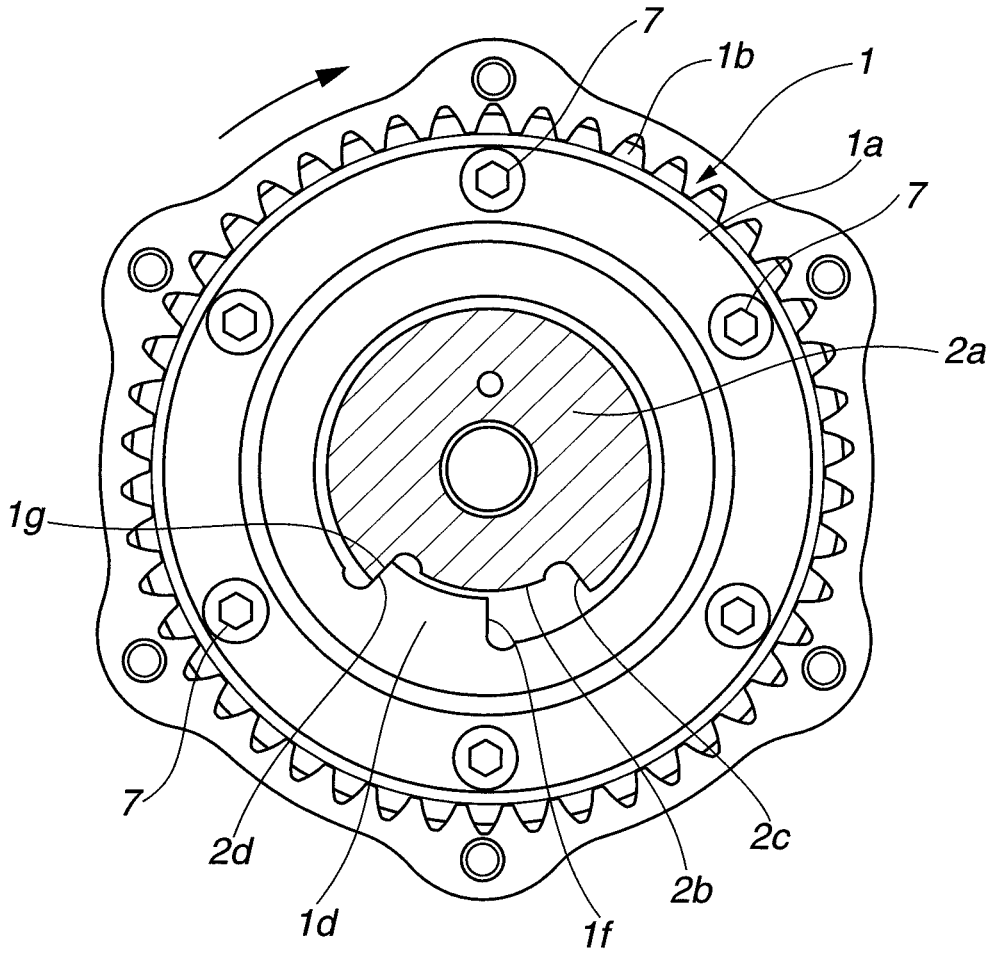
FIG. 3 is a lateral cross section taken along the line II-II of FIG. 1.

Sprocket body 1*a* has an axially-protruding annular edged portion 1*e* formed integral with the outer periphery of its front end. An annular member (an inner peripheral meshing member) 19 is located on the front end of sprocket body 1*a* and positioned coaxially with the axis (the geometric center) of the inner periphery of axially-protruding annular edged portion 1*e*. A large-diameter annular plate 6 is fixedly connected to the front end face (the left-hand side face, viewing FIG. 1) of annular member 19, such that the plate 6, annular member 19, and the outer periphery of sprocket body 1*a* are integrally connected to each other by axially fastening them together with bolts 7 (a fastener). As shown in FIG. 3, the inner peripheral portion of sprocket body 1*a* is partially formed integral with a circular-arc shaped radially-inward-protruding stopper portion 1*d* circumferentially extending over a given circumferential length.

Figure 2:
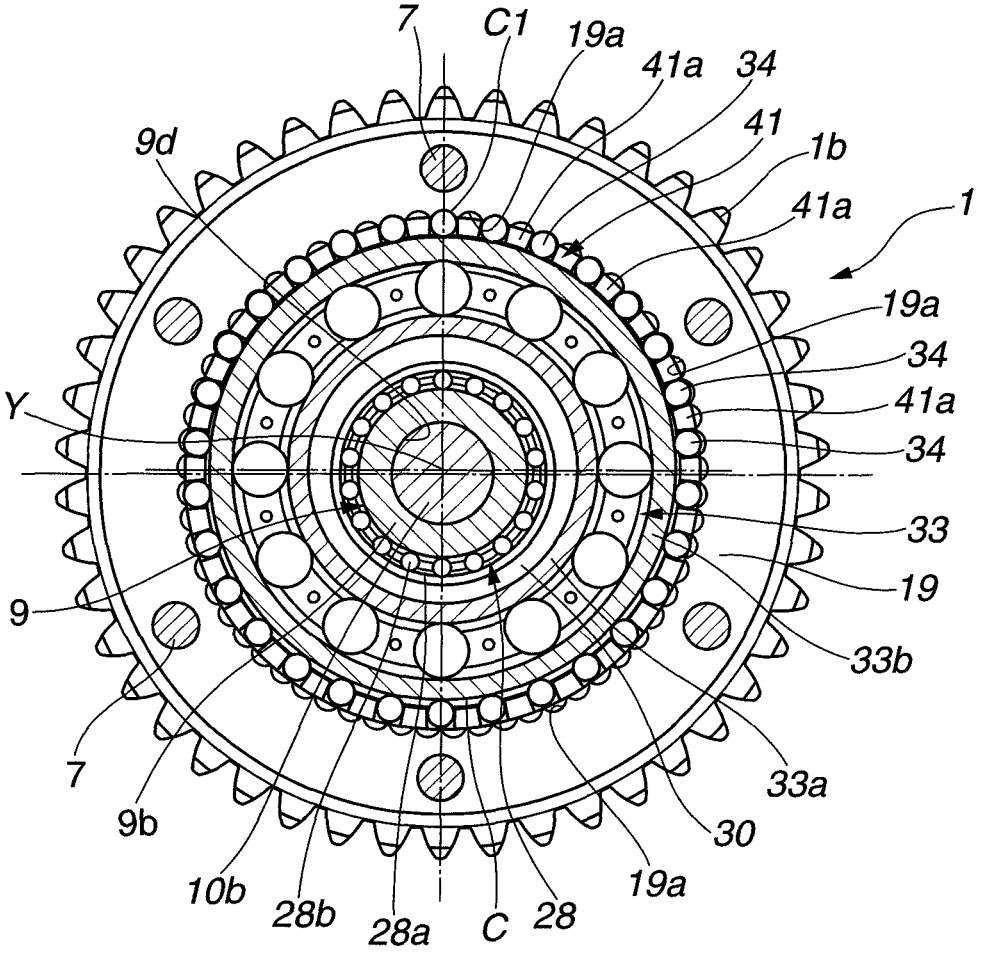
FIG. 2 is a lateral cross section taken along the line I-I of FIG. 1.

The previously-noted annular member 19 is formed on its inner periphery with a plurality of waveform internal teeth 19*a* (see FIG. 2).

A substantially cylindrical housing 5, which constructs a part of an electric motor 12 (described later) of phase converter 4, is fixedly connected to the outer periphery of the front end face of plate 6 by means of bolts 11.

Housing 5 is made of iron-based metal material and formed into a substantially C-shape in lateral cross section. Housing 5 also serves as a yoke of the electric motor 12. The front end (the bottom) of housing 5 is formed as an annular plate-like retaining portion 5*a* on which a stator 16 (described later) is mounted. Housing 5 is laid out such that the outer periphery of housing 5, including the retaining portion 5*a*, is covered by cover member 3 with a given aperture.

Camshaft 2 has two drive cams (per cylinder) integrally formed on its outer periphery for operating the associated two intake valves (not shown) per one engine cylinder. A driven member (a driven rotary member) 9 is fixedly connected to the front end of camshaft 2 by means of a cam bolt 10. The intake valves are permanently biased in their valve-closed directions by valve springs (not shown). Owing to the spring bias of each of valve springs, alternating torque (positive and negative torque fluctuations) is exerted on the camshaft 2.

As shown in FIG. 3, the flanged portion 2*a* of camshaft 2 has a circumferentially-extending stopper recessed groove 2*b*, which is formed along the circumferential direction and into which the radially-inward-protruding stopper portion 1*d* of sprocket body 1*a* is engaged. The stopper recessed groove 2*b* is formed into a circular-arc shape having a given circumferential length greater than the given circumferential length of the radially-inward-protruding stopper portion 1*d*, in such a manner as to permit rotary motion of camshaft 2 within a limited range. Actually, as can be seen from the lateral cross-section of FIG. 3, the clockwise rotary motion of camshaft 2 relative to timing sprocket 1 is restricted by abutment between an anticlockwise end face if of radially-inward-protruding stopper portion 1*d* and a clockwise-opposing end face 2*c* of stopper recessed groove 2*b*. On the other hand, the anticlockwise rotary motion of camshaft 2 relative to timing sprocket 1 is restricted by abutment between a clockwise end face 1*g* of radially-inward-protruding stopper portion 1*d* and an anticlockwise-opposing end face 2*d* of stopper recessed groove 2*b*. More concretely, the maximum phase-retard side angular position of camshaft 2 relative to timing sprocket 1 is restricted by abutment between the clockwise end face 1*g* of radially-inward-protruding stopper portion 1*d* and the anticlockwise-opposing end face 2*d* of stopper recessed groove 2*b*, whereas the maximum phase-advance side angular position of camshaft 2 relative to timing sprocket 1 is restricted by abutment between the anticlockwise end face 1*f* of radially-inward-protruding stopper portion 1*d* and the clockwise-opposing end face 2*c* of stopper recessed groove 2*b*. In other words, the relative phase of the maximum phase-retard side of camshaft 2 to timing sprocket 1 is restricted and determined under an abutted state of the two opposing end faces 2*d* and 1*g*, whereas the relative phase of the maximum phase-advance side of camshaft 2 to timing sprocket 1 is restricted and determined under an abutted state of the two opposing end faces 2*c* and 1*f*. The previously-discussed radially-inward-protruding stopper portion 1*d* and stopper recessed groove 2*b* cooperate with each other to construct a stopper mechanism.

Cam bolt 10 is comprised of a head 10*a* and a shank 10*b* formed integral with the head 10*a*. The boundary of head 10*a* and shank 10*b* is formed integral with a flanged bearing surface (a washer-faced portion) 10*c*. That is, the head 10*a* of cam bolt 10 is a washer-faced head. The shank 10*b* is formed on its outer periphery with a male-screw-threaded portion 10*d*, which is screwed into a female-screw-threaded portion 2*e* machined in the front end of camshaft 2 along the axis of camshaft 2.

Driven member 9 is made of iron-based metal material. As seen from the longitudinal cross section of FIG. 1, the driven member 9 is comprised of a rear-end disk-shaped portion 9*a* and an axially-forward-extending cylindrical-hollow portion 9*b* formed integral with the front end face of disk-shaped portion 9*a*.

The disk-shaped portion 9*a* is integrally formed on the central portion of its rear end face with an annular stepped portion 9*c*, which is configured to be substantially conformable to the shape (in particular, the outside diameter) of the flanged portion 2*a* of camshaft 2. The annular stepped portion 9*c* of driven member 9 and the flanged portion 2*a* of camshaft 2 are fitted to the inner periphery of the inner race 43*a* of the second ball bearing 43. Hereby, when assembling, the axis of camshaft 2 and the axis of driven member 9 can be easily precisely aligned with each other. On the other hand, the outer race 43*b* of the second ball bearing 43 is press-fitted to the inner periphery of circular groove 1*c* of sprocket body 1*a*.

As shown in FIGS. 1-2, the outer periphery of disk-shaped portion 9*a* of driven member 9 is formed integral with a cage 41, which serves as a roller holder for holding a plurality of rollers 34 (rolling elements described later). Cage 41 has a plurality of axially-protruding lugs 41*a* formed integral with the outer periphery of disk-shaped portion 9*a* and extending in the same axial direction as cylindrical-hollow portion 9*b*. As a whole, the axially-protruding lugs 41*a* are shaped into a substantially comb-tooth shape. That is, each of axially-protruding lugs 41*a* has a substantially rectangular cross-section. The axially-protruding lugs 41*a* of cage 41 are configured to be equidistant-spaced from each other with a given circumferential interval in the circumferential direction of the outer periphery of disk-shaped portion 9*a*.

As shown in FIGS. 1-2, cylindrical-hollow portion 9*b* is formed with a central bore 9*d* into which the shank 10*b* of cam bolt 10 is inserted. A needle bearing 28 (described later) is mounted on the outer periphery of cylindrical-hollow portion 9*b*.

Figure 4:
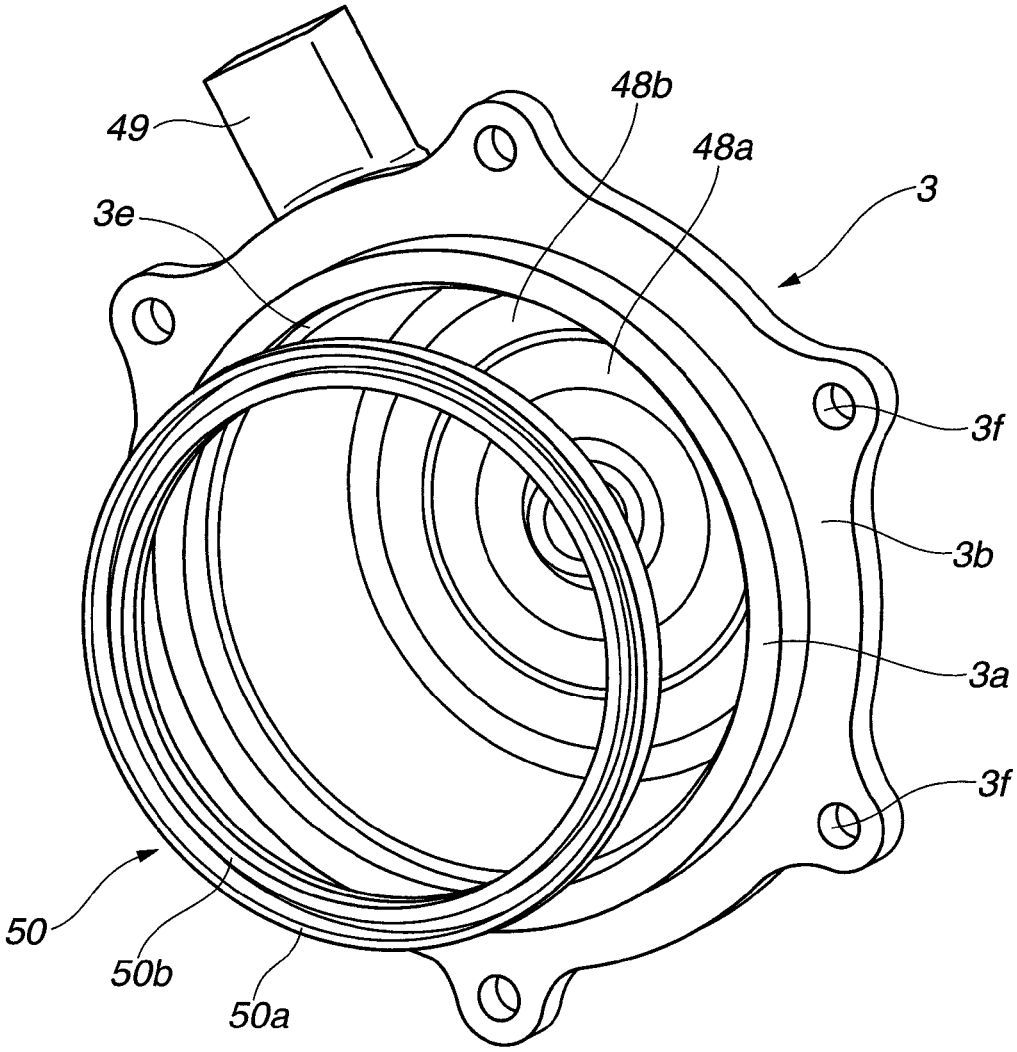
FIG. 4 is a perspective disassembled view illustrating a cover member and a first oil seal, both included in the variable valve actuation apparatus of the embodiment.

As shown in FIGS. 1 and 4, cover member 3 is formed as a comparatively thick-walled integral cover, which is made of synthetic resin material (non-magnetic material). Cover member 3 is comprised of a substantially cup-shaped cover main portion 3*a* and a bracket portion 3*b* formed integral with the outer periphery of cover main portion 3*a*.

Cover main body 3*a* is configured to cover the front end (the left-hand half, viewing FIG. 1) of phase converter 4. In more detail, cover main body 3*a* is laid out to cover almost the entire circumference of housing 5, ranging from the front end face (i.e., plate-like retaining portion 5*a*) via the cylindrical housing portion to the rear end, with a given aperture. Cover main body 3*a* is formed in a substantially center of the frontal flat wall portion with a central access hole 3*c*, for correctly adjusting alignment such that the axis of a first oil seal 50 and the axis of phase converter 4 are aligned with each other. After the assembling work has been completed, a first plug 29 (a closure) having a substantially C-shape in cross section, is fitted to the central access hole 3*c* for closing the inside. As best seen from the perspective view of FIG. 4, bracket portion 3*b* is formed with six bolt insertion holes 3*f*.

Returning to FIG. 1, cover member 3 is fixedly connected to chain cover 40 by means of bolts 47, which are screwed into the chain cover through the respective bolt insertion holes 3*f*. A radially-inside slip ring 48*a* and a radially-outside slip ring 48*b* are attached onto the inside wall surface of the frontal flat wall portion of cover main body 3*a*, such that the left-hand side face (see FIG. 1) of each of slip rings 48*a*-48*b* is buried in the inside wall of cover main body 3*a* and that the right-hand side face of each of slip rings 48*a*-48*b* is exposed to the internal space. Each of slip rings 48*a*-48*b* is formed into a flat annular plate shape. Radially-inside slip ring 48*a* and radially-outside slip ring 48*b* are laid out to be coaxial with each other with a given aperture.

A connector portion 49 is provided at the upper end of cover member 3. Connector portion 49 has a rectangular connector terminal 49*a*, whose root is buried and fixedly connected to the upper end of cover member 3, and a crank-shaped conductive member 40*b*. One end of conductive member 40*b* is connected to the root of connector terminal 49*a*, whereas the other end of conductive member 40*b* is connected to each of slip rings 48*a*-48*b*. Electric current supply from a car battery (not shown) to connector terminal 49*a* is controlled by a control unit 21.

As clearly shown in FIGS. 1 and 4, the first oil seal 50 (a relatively large-diameter seal ring) is interleaved between the inner peripheral surface of the rear end of cover main body 3*a* and the outer peripheral surface of housing 5. The first oil seal 50 is a typical spring-loaded, synthetic-rubber-covered seal ring consisting of a single lip using a spring, a metal case and a dust lip using no spring. The outer periphery of the annular rubber portion 50*a* of oil seal 50 is fitted into an annular groove 3*d* formed in the inner periphery of the rear end of cover member 3. The inner peripheral surface of the annular rubber portion 50*a* functions as a seal surface, which is kept in sliding-contact with the outer peripheral surface of the cylindrical portion of housing 5.

The previously-discussed phase converter 4 is constructed by the electric motor 12, serving as an actuator and located at the front end of camshaft 2 and arranged coaxial with the axis of camshaft 2, and a speed reducer 8. Speed reducer 8 is provided to reduce the rotational speed of the output shaft 13 of electric motor 12 and to transmit the reduced rotational speed (in other words, the increased torque) to camshaft 2.

As can be seen from the cross section of FIG. 1, electric motor 12 is a brush-equipped direct-current (DC) motor. Electric motor 12 is comprised of the housing 5 serving as a yoke and rotating together with timing sprocket 1, the motor output shaft 13 rotatably provided in housing 5, a pair of substantially semi-circular permanent magnets 14-15 fixedly connected onto the inner peripheral surface of the cylindrical portion of housing 5, and the stator 16 mounted on the inside bottom face of the plate-like retaining portion 5*a*.

Motor output shaft 13 is formed into a substantially cylindrical-hollow shape, and serves as an armature. An iron-core rotor 17, having a plurality of magnetic poles, is fixedly connected onto the outer periphery of motor output shaft 13 substantially at a midpoint of the axially-extending cylindrical-hollow motor output shaft 13. An electromagnetic coil 18 is wound on the outer periphery of the iron-core rotor 17. A commutator 20 is press-fitted onto the outer periphery of the front end of the cylindrical-hollow motor output shaft 13. Commutator 20 is divided into a plurality of segments whose number is equal to the number of magnetic poles of iron-core rotor 17. Electromagnetic coil 18 is connected to each of the segments of commutator 20 via a wiring harness. Also, a second plug 31, having a substantially C-shape in cross section, is fitted into the inner peripheral wall of the cylindrical-hollow motor output shaft 13 for closing the inside, after cam bolt 10 has been fastened, thus preventing oil leakage (oil exhaust) from the inside of motor output shaft 13.

Figure 5:
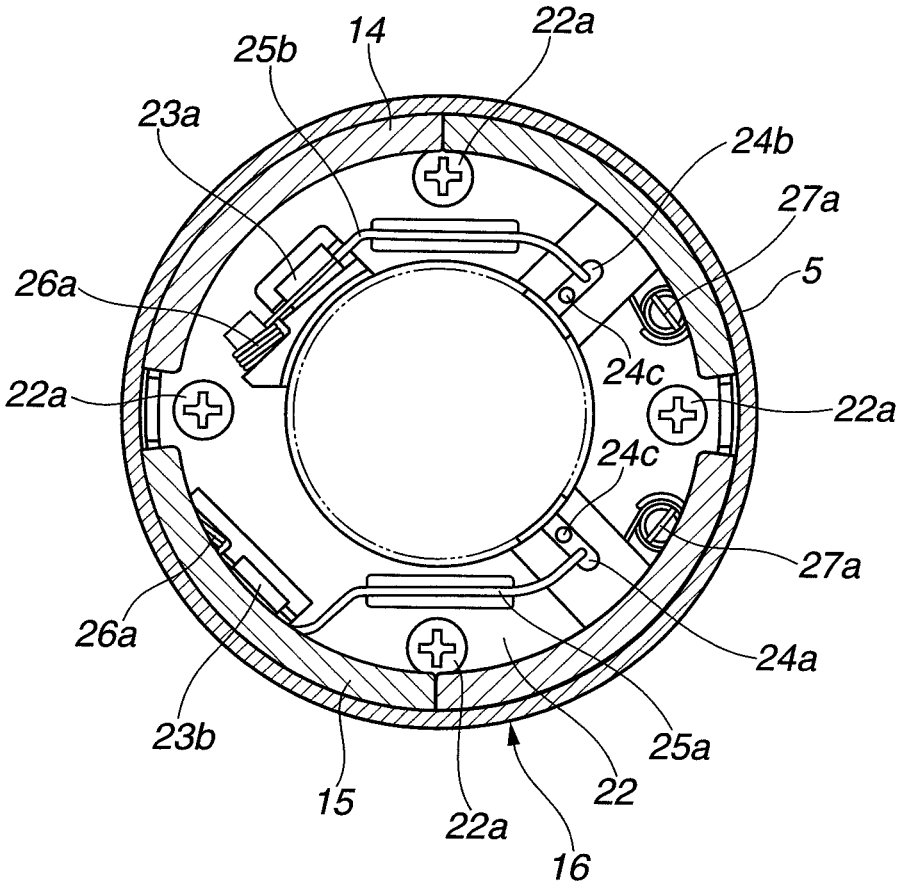
FIG. 5 is a lateral cross section taken along the line of FIG. 1.

As shown in FIG. 5, stator 16 is comprised of an annular plate-like synthetic-resin holder 22, a pair of first brushes 23*a*-23*b*, and a pair of second brushes 24*a*-24*b*. The annular holder 22 is fixedly connected to the inside bottom wall surface of retaining portion 5*a* by means of four screws 22*a*. The first brushes 23*a*-23*b* serve as feeder brushes and loosely fitted into respective axial run through holes formed in both the retaining portion 5*a* and synthetic-resin holder 22. The left-hand end face of the radially-inside first brush 23*a* is in sliding-contact with the slip ring 48*a*, whereas the left-hand end face of the radially-outside first brush 23*b* is in sliding-contact with the slip ring 48*b* (see FIG. 1). The second brushes 24*a*-24*b* serve as current-supply switching brushes and supported on synthetic-resin holder 22 so as to be radially movable along the wall surface of holder 22, while being guided by respective guide pins 24*c*, 24*c*. The circular-arc radially-inside end face of each of the second brushes 24*a*-24*b* is in sliding-contact with the outer peripheral surface of commutator 20.

As clearly shown in FIG. 5, the radially-inside first brush 23*a* and the second brush 24*b* are electrically connected to each other via a pig-tale harness 25*b*. In a similar manner, the radially-outside first brush 23*b* and the second brush 24*a* are electrically connected to each other via a pig-tale harness 25*a*. To ensure electric-contact (sliding-contact), the first brushes 23*a*-23*b* are permanently forced toward the respective slip rings 48*a*-48*b* by means of two torsion springs 26*a*, 26*a*. To ensure electric-contact (sliding-contact), the second brushes 24*a*-24*b* are permanently forced toward the outer periphery of commutator 20 by means of respective torsion springs 27*a*, 27*a*.

Returning to FIG. 1, motor output shaft 13 is rotatably supported on the cam bolt 10 by means of the needle bearing 28 and the third ball bearing 35. Needle bearing 28 is installed on the outer periphery of cylindrical-hollow portion 9*b* of driven member 9. On the other hand, the third ball bearing 35 is installed on the outer periphery of the cam-bolt shank 10*b* in close proximity to the cam-bolt washer-faced portion 10*c*. As can be seen from the cross sections of FIGS. 1-2, the cylindrical-hollow motor output shaft 13 is also formed at the rear end (facing the front end of camshaft 2) integral with a substantially cylindrical-hollow eccentric shaft portion 30. The eccentric shaft portion 30 constructs a part of an eccentric rotation member, which is one component part of speed reducer 8.

As shown in FIG. 2, needle bearing 28 is comprised of a cylindrical retainer 28*a* press-fitted into the inner peripheral surface of eccentric shaft portion 30 and a plurality of needle rollers 28*b* rotatably retained inside of the retainer 28*a*. Each of needle rollers 28*b* is in rolling-contact with the outer peripheral surface of the cylindrical-hollow portion 9*b* of driven member 9. As seen from the cross section of FIG. 1, the inner race 35*a* of the third ball bearing 35 is fixed and sandwiched between the cam-bolt washer-faced portion 10*c* and the front end face of cylindrical-hollow portion 9*b*. On the other hand, the outer race 35*b* of the third ball bearing 35 is positioned and sandwiched between the stepped portion formed on the inner periphery of the cylindrical-hollow motor output shaft 13 and a snap ring 36 (a C-type retaining ring fitted into an annular groove formed in the inner periphery of motor output shaft 13).

A second oil seal 32 (a relatively small-diameter seal ring) is interleaved between the outer peripheral surface of motor output shaft 13 (in close proximity to the eccentric shaft portion 30) and the inner peripheral surface of plate 6, for preventing leakage of lubricating oil from the inside of speed reducer 8 toward the electric motor 12. The second oil seal 32 is a typical spring-loaded, synthetic-rubber-covered seal ring consisting of a single lip using a spring, a metal case and a dust lip using no spring. The inner peripheral portion of the second oil seal 32 is kept in elastic-contact and in sliding-contact with the outer peripheral surface of the cylindrical-hollow motor output shaft 13, so as to apply a frictional resistance to rotation of motor output shaft 13.

As shown in FIG. 1, control unit 21 generally comprises a microcomputer. Control unit 21 includes an input/output interface (I/O), memories (RAM, ROM), and a microprocessor or a central processing unit (CPU). The input/output interface (I/O) of control unit 21 receives input information from various engine/vehicle sensors, namely a crank angle sensor (a crankshaft position sensor), a camshaft angle sensor (a camshaft position sensor), an airflow meter, an engine temperature sensor (an engine coolant temperature sensor), an accelerator opening sensor (an accelerator angular position sensor), and the like. Within control unit 21, the central processing unit (CPU) allows the access by the I/O interface of input informational data signals from the previously-discussed engine/vehicle sensors. The CPU of control unit 21 is responsible for carrying the ignition-timing/throttle/fuel-injection/valve-timing control program stored in memories and is capable of performing necessary arithmetic and logic operations, depending on the current engine/vehicle operating condition, determined based on signals from the engine/vehicle sensors. Computational results (arithmetic calculation results), that is, calculated output signals are relayed through the output interface circuitry of the control unit to output stages (actuators), for electronic spark control, control of an electronically-controlled throttle valve, control of the fuel-injection system, and control of the VTC system. Concretely, control unit 21 is configured to detect an actual relative phase of camshaft 2 to timing sprocket 1 (the crankshaft) responsively to input informational signals from the crank angle sensor and the cam angle sensor and also configured to determine a desired relative phase of camshaft 2 to timing sprocket 1 depending on the current engine/vehicle operating condition. Control unit 21 is further configured to perform normal-rotation/reverse-rotation control of motor output shaft 13 by controlling electric-current supply to electromagnetic coil 18 of electric motor 12. The rotational speed of motor output shaft 13 is reduced by speed reducer 8. In this manner, the actual relative phase of camshaft 2 to timing sprocket 1 can be brought closer to the desired value.

As seen from the cross sections of FIGS. 1-2, speed reducer 8 is mainly comprised of the eccentric shaft portion 30 (constructing a part of the eccentric rotation member) that performs eccentric rotary motion, a first ball bearing 33 (constructing the remainder of the eccentric rotation member) installed on the outer periphery of eccentric shaft portion 30, a plurality of rollers (serving as rolling elements) 34 rotatably installed on the outer periphery of the first ball bearing 33 and circumferentially arranged substantially at regular intervals, and the driven member 9 formed integral with the cage 41, and the annular member 19 with the waveform internal toothed portion 19*a* and the needle bearing 28 installed between the outer periphery of cylindrical-hollow portion 9*b* of driven member 9 and the inner periphery of eccentric shaft portion 30.

Eccentric shaft portion 30 is a substantially cylindrical cam whose geometric center "Y" (see FIG. 2) is slightly displaced from the axis "X" (i.e., a rotation center "X" shown in FIG. 1) of motor output shaft 13 in the radial direction.

The first ball bearing 33 is formed as a relatively large-diameter ball bearing, as compared to the second ball bearing 43 and the third ball bearing 35. As viewed from the longitudinal cross section of FIG. 1 (that is, as viewed in the radial direction), the first ball bearing 33 is laid out to overlap with the needle bearing 28 over almost the entire inner peripheral face of the inner race 33*a* of the first ball bearing 33. A plurality of balls 33*c* are rotatably disposed and confined between the inner and outer races 33*a*-33*b*. The inner race 33*a* is press-fitted onto the outer peripheral surface of eccentric shaft portion 30. Additionally, rollers 34, interleaved between the outer periphery of the outer race 33*b* of the first ball bearing 33 (constructing part of the eccentric rotation member) and the waveform internal toothed portion 19*a* of annular member 19, are held in rolling-contact with the outer peripheral surface of the outer race 33*b*. A crescent-shaped annular clearance C is defined between the outer peripheral surface of the outer race 33*b* and the substantially comb-tooth-shaped protruding portion 41*a* of cage 41. Owing to eccentric rotary motion of eccentric shaft portion 30, the first ball bearing 33 is radially moved by virtue of the crescent-shaped annular clearance C. That is, the crescent-shaped annular clearance C permits a slight radial displacement (a slight oscillating motion) of the first ball bearing 33. As appreciated, the first ball bearing 33 and the eccentric shaft portion 30 construct the eccentric rotation member.

Each of rollers 34 is made of metal material and formed as a cylindrical solid roller. Fully taking account of smooth rolling motion of each of rollers 34, reduced noise and vibrations of the whole VTC device, and the enhanced control responsiveness of the VTC device (as described later in reference to the flowchart of FIG. 7), a specified one of a plurality of roller sets, each of which has been manufactured and prepared beforehand and whose roller sizes (roller outside diameters) differ from each other, is selected. Owing to the eccentric displacement (oscillating motion) of the first ball bearing 33, the radially-inward contact surface of each of rollers 34, included within a given area, is brought into abutment (rolling-contact) with the outer peripheral surface of the outer race 33*b* of the first ball bearing 33. On the other hand, the radially-outward contact surfaces of some of rollers 34, associated with the given area, are fitted into some troughs of internal teeth 19*a* of annular member 19. More concretely, in the eccentric position of the eccentric rotation member (namely, the first ball bearing 33 and eccentric shaft portion 30) shown in FIG. 2, roller 34, located at the 12 o'clock position, is brought into completely fitted-engagement (or deeply meshed-engagement) with the inner face 19*b* of the trough between the uppermost two adjacent internal teeth 19*a*, 19*a*. In contrast, roller 34, located at the 6 o'clock position, is brought out of engagement. That is to say, owing to the eccentric displacement (oscillating motion) of the eccentric rotation member (i.e., the first ball bearing 33 and eccentric shaft portion 30), rollers 34 can radially oscillate, while being circumferentially guided by respective axially-protruding lugs 41*a* of cage 41.

As previously described, cage 41 has the plurality of axially-protruding lugs 41*a* equidistant-spaced from each other with a given circumferential distance for circumferentially partitioning respective rollers 34, while permitting a radial displacement of each of rollers 34. One side face (the backward side face, viewing FIG. 1) of comb-tooth-shaped protruding portion 41*a* of cage 41, facing sprocket body 1*a*, is closed by the left-hand side face of sprocket body 1*a*. The opposite side face (the forward side face, viewing FIG. 1) of comb-tooth-shaped protruding portion 41*a* of cage 41 is opened. When fastening three component parts, namely, plate 6, annular member 19, and sprocket body 1*a* together with bolts 7, the left-hand side opening 41*b* of comb-tooth-shaped protruding portion 41*a* of cage 41 is closed.

Figure 6:
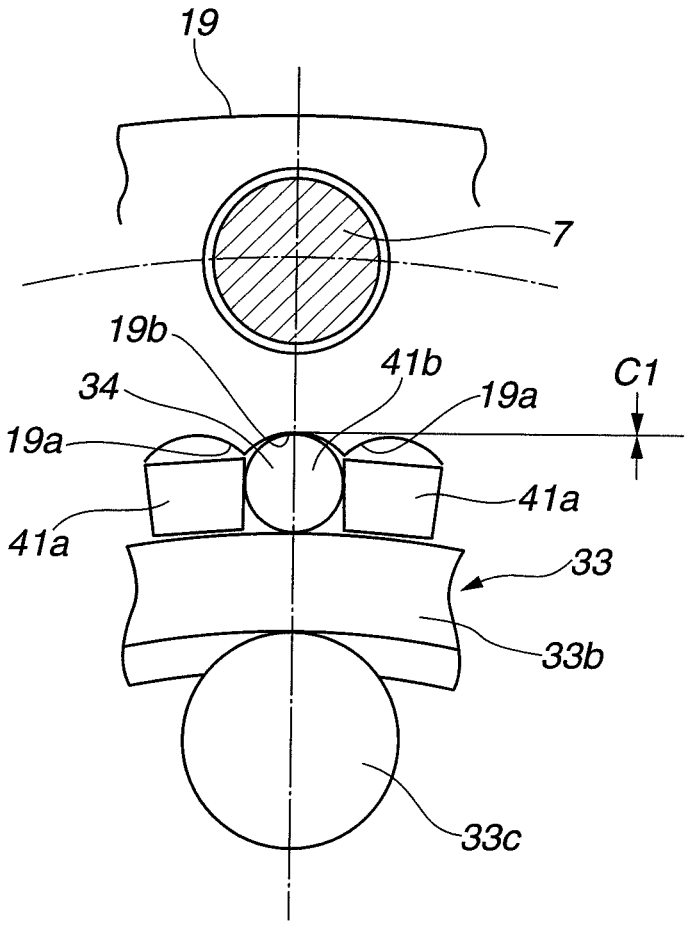
FIG. 6 is a partially enlarged view illustrating the essential part of a speed reducer constructing a part of a phase converter of the variable valve actuation apparatus of the embodiment.

As previously discussed, depending on the eccentric position of the first ball bearing 33, for instance, in the eccentric position of the first ball bearing 33 shown in FIG. 2, roller 34, located at the 6 o'clock position, is brought out of fitted-engagement with either one of the two troughs among the lowermost three adjacent internal teeth 19*a*. Actually, in FIG. 2, the roller 34 is positioned on the top of the ridged portion of the lowermost internal tooth 19*a*. In contrast, in the eccentric position of the first ball bearing 33 shown in FIG. 2, roller 34, located at the 12 o'clock position, is deeply (completely) fitted into the trough between the uppermost two adjacent internal teeth 19*a*, 19*a*, but, as shown in FIG. 6, a very small clearance C1, ranging from approximately 10 μm to 40 μm, is provided between the inner face 19*b* of the trough of the uppermost two adjacent internal teeth 19*a*, 19*a* and the circumference of roller 34, located at the 12 o'clock position. By virtue of the provision of the very small clearance C1 properly adjusted, it is possible to ensure smooth rolling motion of each of rollers 34, reduced noise and vibrations of the whole VTC device, and the enhanced control responsiveness of the VTC device. When assembling component parts of the variable valve actuation apparatus (the VTC device), considerably severe clearance adjustment, in other words, considerably severe clearance management (described later in reference to the flowchart of FIG. 7) for very small clearance C1 (in other words, a very small radial clearance of speed reducer 8) is accomplished.

To ensure smooth operation of the motor-driven phase-converter equipped variable valve actuation apparatus, lubricating oil is supplied into the interior space of speed reducer 8 by lubricating-oil supply/exhaust means. As shown in FIG. 1, the lubricating-oil supply/exhaust means is comprised of an annular oil supply passage 45, an axial oil supply hole 46, an oil groove 46*a*, a small-diameter axial oil supply hole 46*b*, and large-diameter oil exhaust holes (not shown). Annular oil supply passage 45 is annularly grooved in the outer periphery of the journal of camshaft 2 rotatably supported by camshaft journal bearing 44. Axial oil supply hole 46 is formed in the front end of camshaft 2 to communicate the annular oil supply passage 45. Oil groove 46*a* is formed in the front end face of camshaft 2 to communicate the downstream end of axial oil supply hole 46. Small-diameter axial oil supply hole 46*b* is formed as a through hole in the driven member 9 such that one end of axial oil supply hole 46*b* is opened into the oil groove 46*a* and the other end of axial oil supply hole 46*b* is opened into the internal space defined near both the needle bearing 28 and the first ball bearing 33. Large-diameter oil exhaust holes (not shown) are formed in the driven member 9 as oil outlets.

Lubricating oil is constantly fed from the discharge port of an oil pump (now shown) into the oil supply passage 45 via a main oil gallery (not shown) formed in the cylinder head. Thus, by the previously-discussed lubricating-oil supply/exhaust means (i.e., annular oil supply passage 45, axial oil supply hole 46, oil groove 46*a*, small-diameter axial oil supply hole 46*b*, and large-diameter oil exhaust holes), sufficient lubricating oil can be constantly fed to the needle bearing 28, the first ball bearing 33, internal teeth 19*a* of annular member (inner peripheral meshing member) 19, rollers 34, and the axially-protruding lugs 41*a* of cage 41.

The fundamental operation of the variable valve actuation apparatus (the VTC device) of the embodiment is hereunder described in detail.

When the engine crankshaft rotates, timing sprocket 1 rotates in synchronism with rotation of the crankshaft through the timing chain 42. On the one hand, torque flows from the timing sprocket 1 through the annular member 19 via the plate 6 to the housing 5 of electric motor 12, and thus permanent magnets 14-15 and stator 16, all attached to the inner periphery of housing 5, rotate together with the housing 5. On the other hand, torque flows from the timing sprocket 1 through the annular member 19 via the rollers 34, cage 41, and driven member 9 to the camshaft 2. Camshaft 2 is rotated at ½ the revolution speed of the crankshaft for opening the intake valves against the spring forces of the valve springs by the intake-valve cams.

During a normal operating condition after the engine start-up, responsively to a control signal from control unit 21, an electric current is applied from the battery (an electric power source) through the slip rings 48*a*-48*b* and brushes to the electromagnetic coil 18 so as to perform normal-rotation/reverse-rotation control of motor output shaft 13. As a result, torque, produced by electric motor 12, is transmitted through the speed reducer 8 (including the eccentric shaft portion 30, the first ball bearing 33, rollers 34, cage 41, driven member 9, annular member 19, and needle bearing 28) to the camshaft 2, and thus an angular phase of camshaft 2 relative to timing sprocket 1 is controlled and changed.

That is, when eccentric shaft portion 30 rotates eccentrically during rotation of motor output shaft 13, each of rollers 34 moves and relocates from one of two adjacent internal teeth 19*a*, 19*a* to the other with one-tooth displacement per one complete revolution of motor output shaft 13, while being held in rolling-contact with the outer race 33*b* of the first ball bearing 33 and simultaneously radially guided by the side face of the associated axially-protruding lug 41*a* of cage 41. By way of the repeated relocations of each of rollers 34 every revolutions of motor output shaft 13, rollers 34 move in the circumferential direction with respect to the waveform internal toothed portion 19*a* of annular member 19, while being held in rolling-contact with the outer race 33*b* of the first ball bearing 33. In this manner, torque is transmitted through driven member 9 to camshaft 2, while the rotational speed of motor output shaft 13 is reduced. The reduction ratio of this type of speed reducer 8 can be determined by the number of rollers 34 (in other words, the number of axially-protruding lugs 41*a* of cage 41). The fewer the number of rollers 35 (axially-protruding lugs 41*a*), the lower the reduction ratio.

As discussed above, by controlling of the operation of phase converter 4 (constructed by electric motor 12 and speed reducer 8), that is, by execution of the normal-rotation/reverse-rotation control of motor output shaft 13, an angular phase of camshaft 2 relative to timing sprocket 1 can be changed, and as a result intake-valve open timing (IVO) and intake-valve closure timing (IVC) can be phase-advanced or phase-retarded. As clearly shown in FIG. 3, the clockwise rotary motion (normal-rotational motion) of camshaft 2 relative to timing sprocket 1 is restricted by abutment between the anticlockwise end face 1*f* of radially-inward-protruding stopper portion 1*d* and the clockwise-opposing end face 2*c* of stopper recessed groove 2*b*. On the other hand, the anticlockwise rotary motion (reverse-rotational motion) of camshaft 2 relative to timing sprocket 1 is restricted by abutment between the clockwise end face 1*g* of radially-inward-protruding stopper portion 1*d* and the anticlockwise-opposing end face 2*d* of stopper recessed groove 2*b*.

That is to say, when driven member 9 (camshaft 2) rotates in the same rotation direction (indicated by the arrow in FIG. 3) as timing sprocket 1 during eccentric rotary motion of eccentric shaft portion 30, the maximum normal-rotational motion of driven member 9 (camshaft 2) is restricted by abutment between the anticlockwise end face 1*f* of radially-inward-protruding stopper portion 1*d* and the clockwise-opposing end face 2*c* of stopper recessed groove 2*b*. Thus, the angular phase of camshaft 2 relative to timing sprocket 1 is changed to the maximum phase-advance state.

Conversely, when driven member 9 (camshaft 2) rotates in the reverse-rotational direction (opposite to the direction indicated by the arrow in FIG. 3) during eccentric rotary motion of eccentric shaft portion 30, the maximum reverse-rotational motion of driven member 9 (camshaft 2) is restricted by abutment between the clockwise end face 1*g* of radially-inward-protruding stopper portion 1*d* and the anticlockwise-opposing end face 2*d* of stopper recessed groove 2*b*. Thus, the angular phase of camshaft 2 relative to timing sprocket 1 is changed to the maximum phase-retard state.

As a result, intake-valve open timing and intake-valve closure timing can be properly phase-changed, so as to improve the engine performance, such as fuel economy and engine power output, depending on the engine/vehicle operating condition.

As previously discussed, by the provision of the stopper mechanism (i.e., radially-inward-protruding stopper portion 1*d* of sprocket body 1*a* and stopper recessed groove 2*b* of camshaft flanged portion 2*a*), the maximum phase-advance angular position and the maximum phase-retard angular position of camshaft 2 relative to timing sprocket 1 can be certainly restricted.

A series of procedures for adjusting very small clearance C1 between the circumference of roller 34 and the inner face 19*b* of the trough of the two adjacent internal teeth 19*a*, 19*a* of annular member 19 are hereunder described. Briefly speaking, the considerably severe adjustment of very small clearance C1 is performed by replacing or exchanging a reference roller set (described later) with a different-size roller set that ensures an allowable clearance range (e.g., 10 μm-40 μm), only when, with the reference roller set installed between the outer race 33*b* of the first ball bearing 33 and the waveform internal toothed portion 19*a* of annular member 19, the actually-measured clearance C1 is out of the allowable clearance range, that is, C1<10 μm or 40 μm<C1. The details of the roller-set exchanging method (in other words, the details of the speed-reducer very small radial clearance adjustment) are described in reference to the flowchart of FIG. 7 and the partially-enlarged, clearance-C1-adjustment explanatory views of FIGS. 8A-8B.

Figure 7:
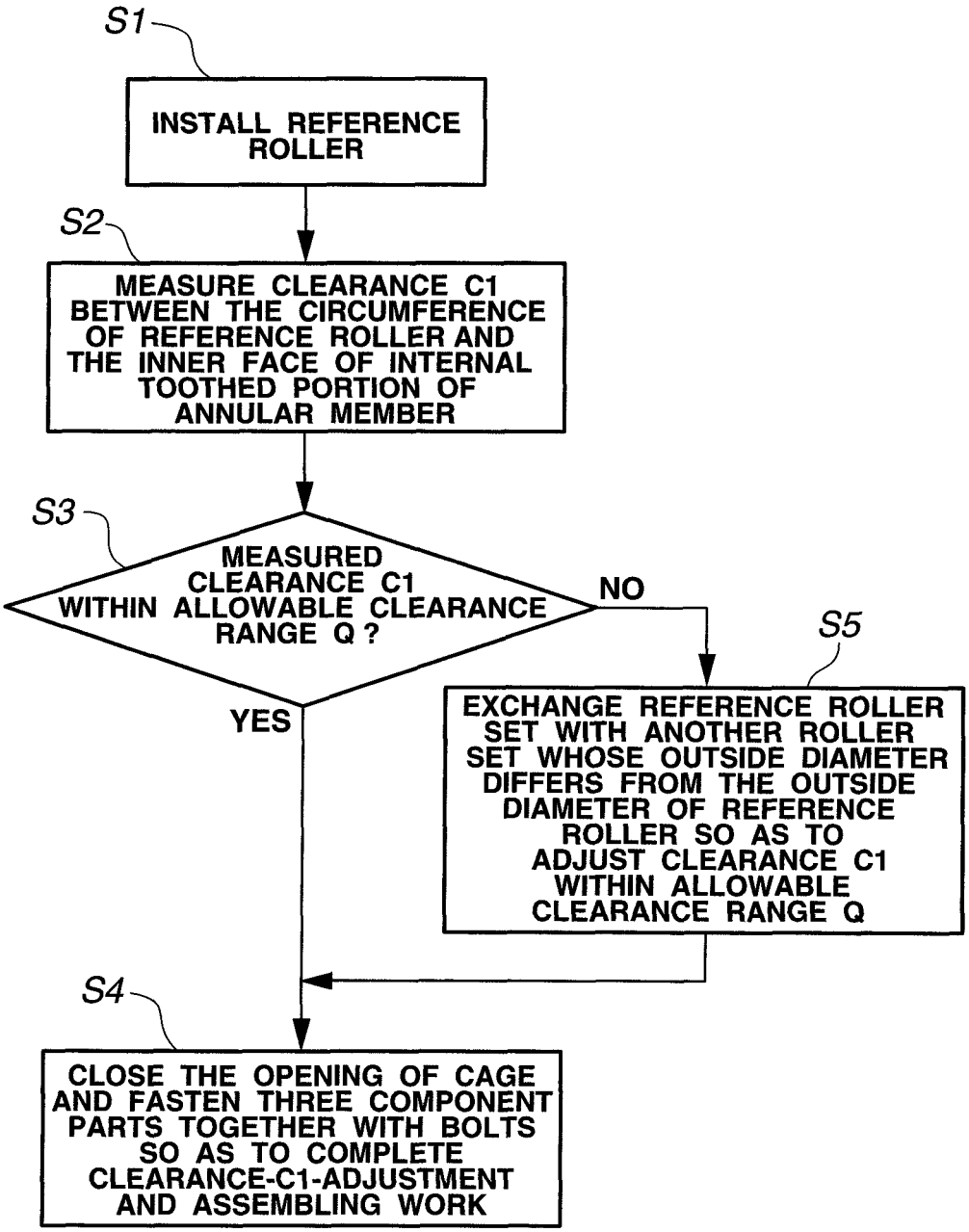
FIG. 7 is a flowchart illustrating a series of procedures for adjustment of a clearance C1 of the speed reducer of the variable valve actuation apparatus of the first embodiment.
Figure 8B:
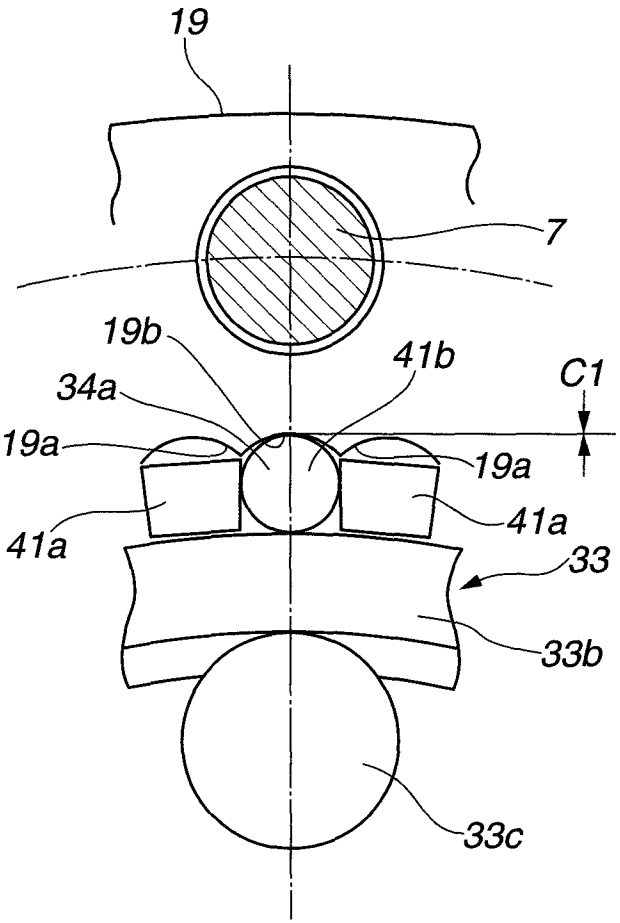
FIG. 8B is a partially enlarged view illustrating a clearance measurement state in which the clearance C1 of the speed reducer is measured.
Figure 8A:
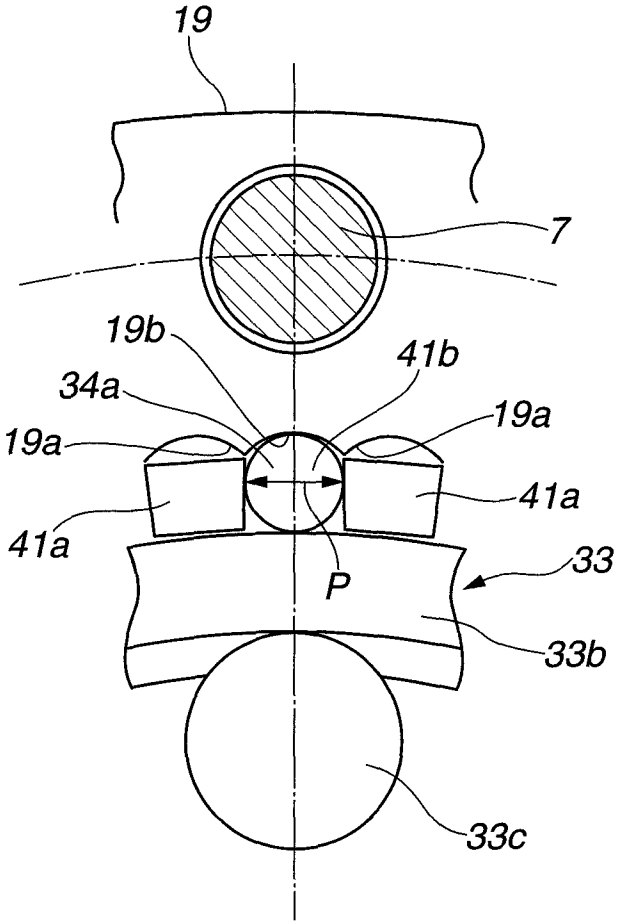

Referring now to FIG. 7, at step S1, first of all, a reference roller 34*a*, manufactured and prepared beforehand, is installed and deeply engaged in a space defined between (i) the inner face 19*b* of the trough of two adjacent internal teeth 19*a*, 19*a* of annular member 19 and (ii) the outer race 33*b* of the first ball bearing 33, positioned in close proximity to each other in the radial direction (in other words, in an eccentric direction of the eccentric rotation member (30, 33) whose geometric center "Y" is displaced from the rotation center "X" of motor output shaft 13), and assembled through the left-hand side opening 41*b* of comb-tooth-shaped protruding portion 41*a* of cage 41 (see FIG. 8A). The outside diameter P (i.e., a reference outside diameter) of reference roller 34*a* is determined or set based on a reference annular member 19 with an internal toothed portion 19*a* precisely-machined and having a less dimensional deviation and a reference outer race 33*b* precisely-manufactured and having a less dimensional deviation.

Secondly, at step S2, a clearance C1 between the inner face 19*b* of the trough of the two adjacent internal teeth 19*a*, 19*a* of annular member 19 and the circumference of reference roller 34*a* is measured (see FIG. 8B).

Thirdly, at step S3, a check is made to determine whether the measured clearance C1 is within an allowable clearance range Q from 10 μm to 40 μm. As described later, this allowable clearance range Q from 10 μm to 40 μm is determined based on experimental results (assured by the inventors of the present invention, while changing the size (the dimension) of clearance C1) concerning a level of noise and vibrations, a phase fluctuation from a desired value, and a mean deviation of a control responsiveness of the VTC device.

Due to individual differences (individual machining accuracies) of first ball bearings 33 manufactured, in particular, due to dimensional deviations of outside diameters of outer races 33*b* manufactured and/or dimensional deviations of inside diameters of waveform internal toothed portions 19*a* of annular members 19 manufactured, the size of clearance C1 tends to change.

When the answer to step S3 is in the affirmative (YES), that is, 10 μm≤C1≤40 μm, the routine proceeds from step S3 to step S4. Conversely when the answer to step S3 is in the negative (NO), that is, C1<10 μm or 40 μm<C1, the routine proceeds from step S3 to step S5.

At step S4, under a state where the reference roller set 34*a* has been fitted and installed between the outer race 33*b* and the waveform internal toothed portion 19*a*, the left-hand side opening 41*b* of comb-tooth-shaped protruding portion 41*a* of cage 41 is closed by the plate 6 and then the plate 6, the annular member 19, and the sprocket body 1*a* are fastened together with bolts 7. In this manner, one complete cycle of the clearance-C1-adjustment and assembling work terminates.

When the measured clearance C1 is out of the allowable clearance range Q, at step S5, another roller 34, whose outside diameter differs from the outside diameter of reference roller 34*a*, is selected such that clearance C1 can be adjusted within the allowable clearance range Q, that is, 10 μm≤C1≤40 μm. Concretely, in the case that the clearance C1, measured with reference roller 34*a* installed, exceeds the allowable clearance range Q (i.e., 40 μm<C1), another roller 34, whose outside diameter is slightly greater than the outside diameter P of reference roller 34*a*, is selected. Conversely, in the case that the clearance C1, measured with reference roller 34*a* installed, is less than the allowable clearance range Q (i.e., C1<10 μm), another roller 34, whose outside diameter is slightly less than the outside diameter P of reference roller 34*a*, is selected. By simply exchanging the reference roller set 34*a* with the properly-selected roller set whose outside diameter differs from the outside diameter P of reference roller 34*a*, the clearance-C1-adjustment can be achieved. Thereafter, the left-hand side opening 41*b* of comb-tooth-shaped protruding portion 41*a* of cage 41 is closed by the plate 6 and then the plate 6, the annular member 19, and the sprocket body 1*a* are fastened together with bolts 7. In this manner, one complete cycle of the clearance-C1-adjustment and assembling work terminates.

EXPERIMENTAL EXAMPLE

Figure 9:
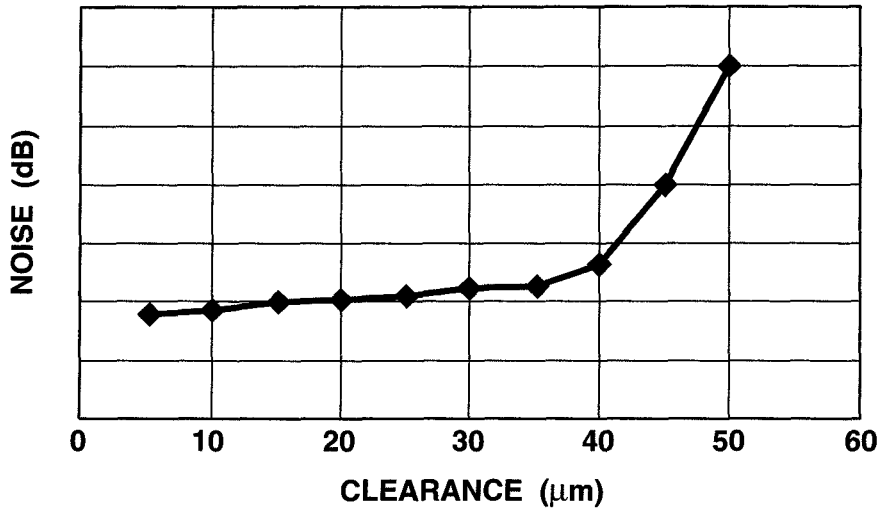
FIG. 9 is a graph of experimental results showing the relationship between the clearance C1 of the speed reducer and a noise level of the whole VTC device.
Figure 10:
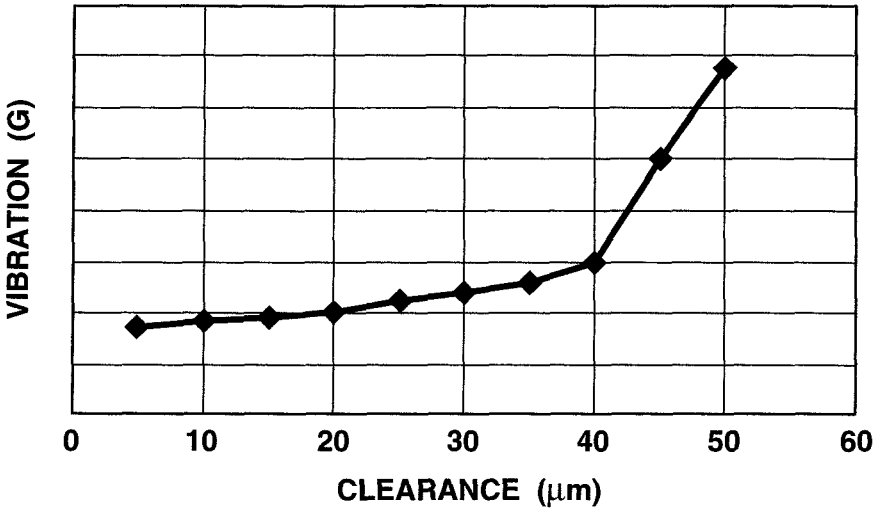
FIG. 10 is a graph of experimental results showing the relationship between the clearance C1 of the speed reducer and a magnitude of vibration of the whole VTC device.
Figure 11:
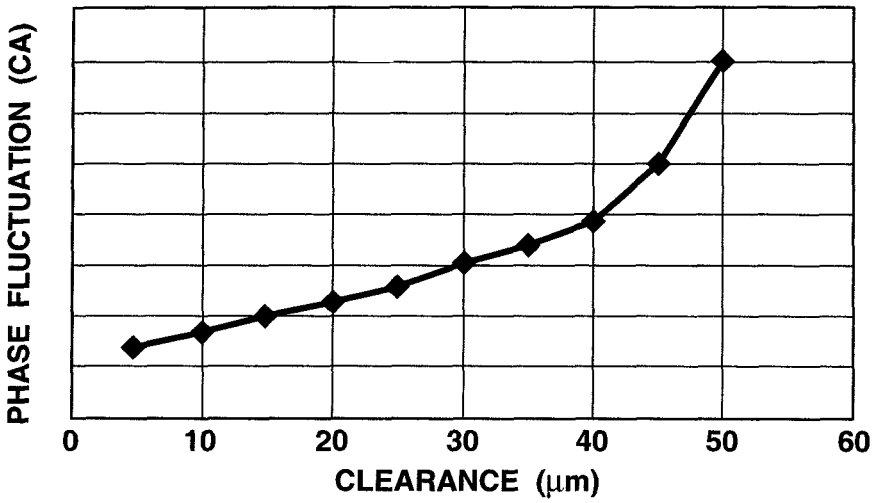
FIG. 11 is a graph of experimental results showing the relationship between the clearance C1 of the speed reducer and a magnitude of a phase fluctuation deviated from a given phase angle under a given phase-angle holding state, concretely, under a maximum phase-advance holding state of the VTC device.
Figure 12:
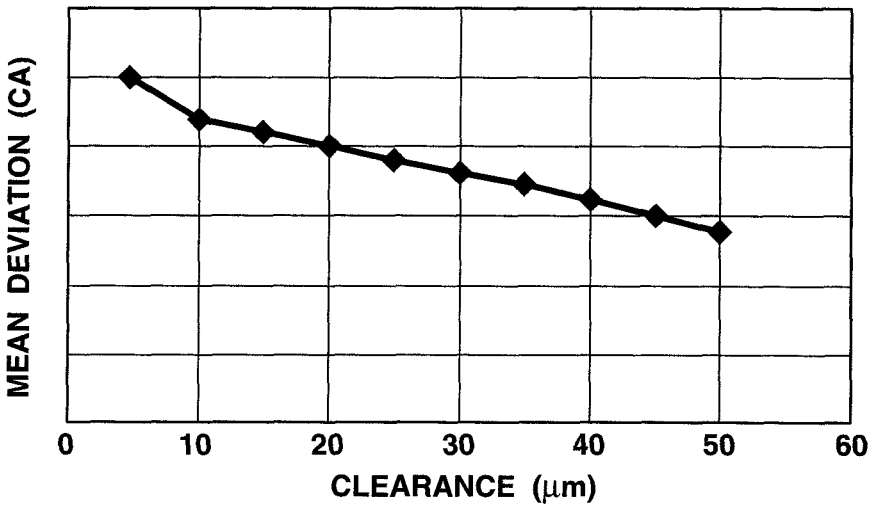
FIG. 12 is a graph of experimental results showing the clearance C1 of the speed reducer and a mean deviation of the control responsiveness of the VTC device.

The reason for the specified setting on the allowable clearance range Q of very small clearance C1 (e.g., 10 μm-40 μm), is based on experimental results assured by the inventors of the present invention. The details of these experimental results are hereunder described in detail in reference to the graphs of FIGS. 9-12 showing several experimental results, plotted while setting and changing the previously-noted clearance C1 to approximately 5 μm, 10 μm, 15 μm, 20 μm, 25 μm, 30 μm, 35 μm, 40 μm, 45 μm, and 50 μm, in that order. FIG. 9 shows the relationship between the clearance C1 (unit: μm) of speed reducer 8 (exactly, a very small radial clearance between the circumference of roller 34 and the inner face 19*b* of annular member 19) and a noise level (unit: dB) of the whole VTC device. FIG. 10 shows the relationship between the clearance C1 (unit: μm) and a vibration in terms of vibration acceleration (unit: G) of the whole VTC device. FIG. 11 shows the relationship between the clearance C1 (unit: μm) and a magnitude (unit: degrees of crankangle) of a phase fluctuation (a phase change) from a given phase angle under a given phase-angle holding state, concretely under a maximum phase-advance holding state of the VTC device. FIG. 12 shows the relationship between the clearance C1 (unit: μm) and a mean deviation (unit: degrees of crankangle) of the control responsiveness of the VTC device.

As per the noise level (see the graph of FIG. 9), within the clearance range from approximately 5 μm to 35 μm, the graph of FIG. 9 shows a comparatively low, flat noise-level characteristic. In contrast, when the clearance C1 exceeds 40 μm, and further increases via 45 μm up to 50 μm, the noise level tends to rapidly rise.

As per the vibration (see the graph of FIG. 10), as seen from comparison between the two characteristic curves of FIGS. 9-10, the vibration characteristic of FIG. 10 is similar to the noise-level characteristic of FIG. 9. That is, within the clearance range from approximately 5 μm to 40 μm, the graph of FIG. 10 shows a gradual, slow vibration increase tendency. In contrast, when the clearance C1 exceeds 40 μm, and further increases up to 50 μm, the vibration tends to rapidly rise.

As per the magnitude of the phase fluctuation from the given phase angle under the maximum phase-advance holding state of the VTC device (see the graph of FIG. 11), within the clearance range from approximately 5 μm to 40 μm, the graph of FIG. 11 shows a gradual, moderate phase-fluctuation characteristic. In contrast, when the clearance C1 exceeds 40 μm, and further increases up to 50 μm, the phase fluctuation tends to rapidly rise.

As per the mean deviation of the control responsiveness of the VTC device (see the graph of FIG. 12), of these tested clearances, at the clearance C1 of 5 μm the mean deviation becomes a highest value. As can be seen from the characteristic curve of FIG. 12, the mean deviation tends to gradually fall over the entire range of clearance C1 from 5 μm to 50 μm. Concretely, the mean deviation tends to gradually fall from the first tested clearance of 5 μm. When the clearance C1 exceeds 40 μm, and further increases via 45 μm up to 50 μm, the mean deviation tends to remarkably fall.

As can be totally appreciated from the experimental results of FIGS. 9-12, it is preferable to set the clearance C1 within a clearance range from approximately 5 μm to 40 μm. To satisfy all requirements, namely, reduced noise/vibrations and reduced phase fluctuation of the VTC device, and enhanced control responsiveness of the VTC device, it is more preferable to set the clearance C1 within a clearance range from 10 μm to 40 μm. On the basis of the previously-discussed experimental results, in the shown embodiment, the allowable clearance range Q of clearance C1 of speed reducer 8 is set to a specified clearance range from 10 μm to 40 μm.

As appreciated from the above, by virtue of the proper setting of the allowable clearance range Q of clearance C1, according to the variable valve actuation apparatus (e.g., the VTC device) of the first embodiment, it is possible to effectively reduce noise/vibrations arising from alternating torque transmitted from camshaft 2 to the VTC device and also to ensure the good control responsiveness of the VTC device, during operation of the VTC device.

According to the clearance-C1-adjustment procedures of FIG. 7, a plurality of roller sets, whose roller sizes (roller outside diameters) differ from each other, have been manufactured and prepared beforehand. When assembling component parts of the motor-driven phase-converter equipped variable valve actuation apparatus, in accordance with the procedures for adjusting very small clearance C1 as previously discussed in reference to the flowchart of FIG. 7, it is possible to certainly adjust an error of very small clearance C1 to an allowable value, that is, 10 μm≤C1≤40 μm, by simply exchanging a certain roller set (that is, a reference roller set) of the plurality of roller sets with another roller set. By way of precise and easy speed-reducer clearance-C1-adjustment, it is possible to adequately suppress manufacturing costs from undesirably increase.

[Second Embodiment]

Figure 13:
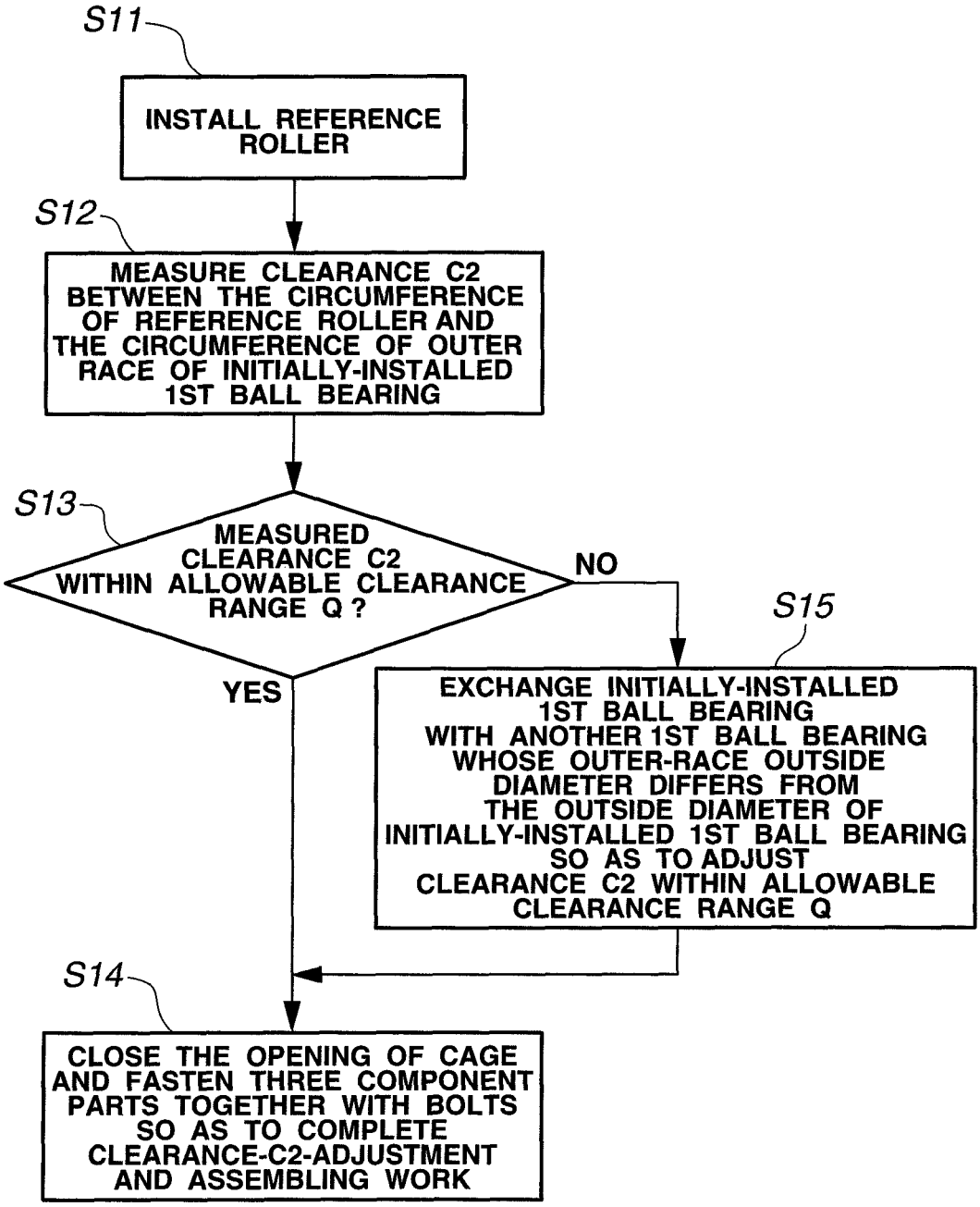
FIG. 13 is a flowchart illustrating a series of modified clearance-adjustment procedures of the speed reducer of the variable valve actuation apparatus of the second embodiment.

Referring to FIGS. 13 and 14A-14C, there are shown a series of modified clearance-adjustment procedures of speed reducer 8 of the variable valve actuation apparatus of the second embodiment. The fundamental construction and operation of the variable valve actuation apparatus (the VTC device) of the second embodiment are identical to those of the first embodiment. The modified clearance-adjustment procedures of FIG. 13 are somewhat different from the clearance-adjustment procedures of FIG. 7, as follows.

According to the clearance-C1-adjustment procedures of FIG. 7, considerably severe very small clearance adjustment of speed reducer 8 is performed by replacing or exchanging the reference roller set with a different-size roller set that ensures the allowable clearance range (i.e., 10 μm-40 μm), only when, with the reference roller set installed between the outer race 33*b* of the first ball bearing 33 and the waveform internal toothed portion 19*a* of annular member 19, the actually-measured clearance C1 is out of the allowable clearance range Q, that is, C1<10 μm or 40 μm<C1.

In contrast, according to the modified clearance-C2-adjustment procedures of FIG. 13, considerably severe very small clearance adjustment of speed reducer 8 is performed by replacing or exchanging a certain first ball bearing 33 (hereinafter referred to as "initially-installed first ball bearing 33"), which was installed first, with a different-outer-race-size first ball bearing that ensures the allowable clearance range (i.e., 10 μm-40 μm), only when, with the reference roller set installed between the outer race 33*b* of the initially-installed first ball bearing 33 and the waveform internal toothed portion 19*a* of annular member 19, an actually-measured clearance C2 (described later) is out of the allowable clearance range, that is, C2<10 μm or 40 μm<C2. That is to say, in the case of the modified clearance-adjustment procedures of FIG. 13, a plurality of first ball bearings, whose outer-race sizes (outer-race outside diameters) differ from each other, have been manufactured and prepared beforehand. When assembling component parts of the motor-driven phase-converter equipped variable valve actuation apparatus, a specified one of the plurality of first ball bearings 33 is selected such that clearance C2 between roller 34 and outer race 33*b* can be adjusted within the allowable clearance range Q, that is, 10 μm≤C2≤40 μm.

Figure 14A:
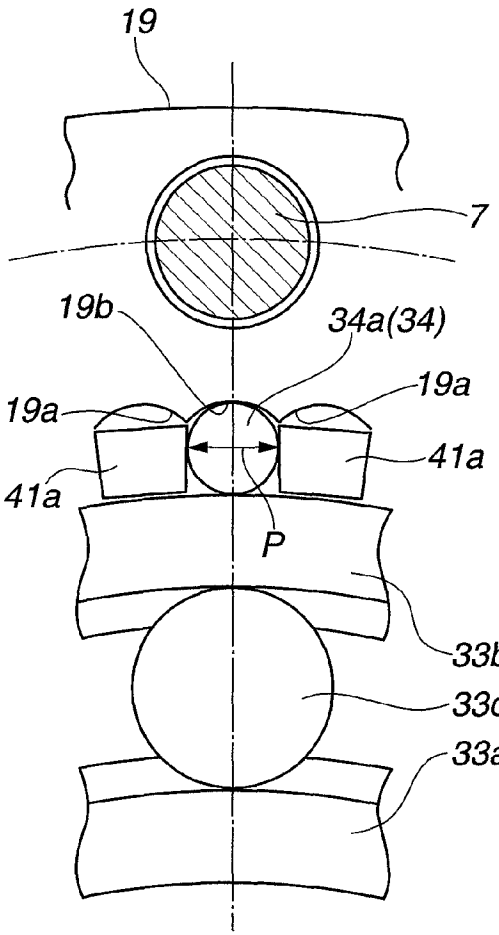
FIG. 14A is a partially enlarged view illustrating a reference-roller installation state where a reference roller has been installed prior to the clearance adjustment.
Figure 14B:
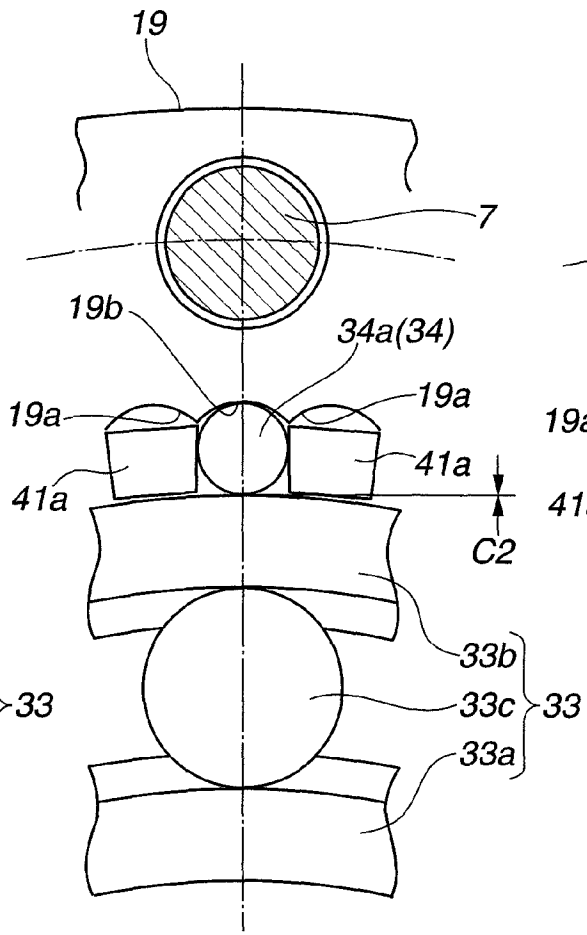
FIG. 14B is a partially enlarged view illustrating a clearance measurement state in which the clearance C2 of the speed reducer is measured.
Figure 14C:
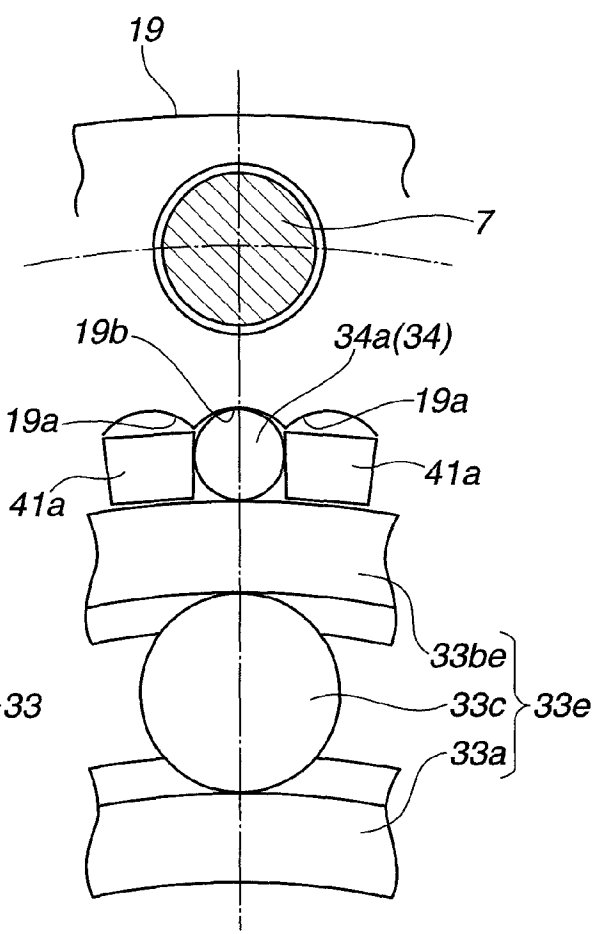
FIG. 14C is a partially enlarged view illustrating the essential part of the speed reducer after the clearance adjustment has been completed.

The details of the first ball bearing exchanging method (in other words, the details of the modified speed-reducer very small radial clearance adjustment) are described in reference to the flowchart of FIG. 13 and the partially-enlarged, clearance-C2-adjustment explanatory views of FIGS. 14A-14C.

Referring now to FIG. 13, at step S11, first of all, reference roller 34*a* is installed and deeply engaged in a space defined between (i) the inner face 19*b* of the trough of two adjacent internal teeth 19*a*, 19*a* of annular member 19 and (ii) the outer race 33*b* of an initially-installed first ball bearing 33, positioned in close proximity to each other in the radial direction (in other words, in an eccentric direction of the eccentric rotation member (30, 33) whose geometric center "Y" is displaced from the rotation center "X" of motor output shaft 13), and assembled through the left-hand side opening 41*b* of comb-tooth-shaped protruding portion 41*a* of cage 41 (see FIG. 14A). The outside diameter P (i.e., a reference outside diameter) of reference roller 34*a* is determined or set based on a reference annular member 19 of an internal toothed portion 19*a* precisely-machined and having a less dimensional deviation and a reference outer race 33*b* precisely-manufactured and having a less dimensional deviation.

Secondly, at step S12, a clearance C2 between the circumference of outer race 33*b* of the initially-installed first ball bearing 33 and the circumference of reference roller 34*a* is measured (see FIG. 14B).

Thirdly, at step S13, a check is made to determine whether the measured clearance C2 is within the allowable clearance range Q from 10 μm to 40 μm, that is, 10 μm≤C2≤40 μm.

Due to individual differences (individual machining accuracies) of first ball bearings 33 manufactured, in particular, due to dimensional deviations of outside diameters of outer races 33*b* manufactured and/or dimensional deviations of inside diameters of waveform internal toothed portions 19*a* of annular members 19 manufactured, the size (the dimension) of clearance C2 tends to change.

When the answer to step S13 is in the affirmative (YES), that is, 10 μm≤C2≤40 μm, the routine proceeds from step S13 to step S14. Conversely when the answer to step S13 is in the negative (NO), that is, C2<10 μm or 40 μm<C2, the routine proceeds from step S13 to step S15.

At step S14, under a state where the initially-installed first ball bearing 33 has been fitted and assembled, the left-hand side opening 41*b* of comb-tooth-shaped protruding portion 41*a* of cage 41 is closed by the plate 6 and then the plate 6, the annular member 19, and the sprocket body 1*a* are fastened together with bolts 7. In this manner, one complete cycle of the clearance-C2-adjustment and assembling work terminates.

When the measured clearance C2 is out of the allowable clearance range Q, at step S15, another first ball bearing 33*e*, whose outer-race outside diameter differs from the outside diameter of outer race 33*b* of the initially-installed first ball bearing 33, is selected such that clearance C2 can be adjusted within the allowable clearance range Q, that is, 10 μm≤C2≤40 μm. Concretely, in the case that the clearance C2, measured with the initially-installed first ball bearing 33, exceeds the allowable clearance range Q (i.e., 40 μm<C2), another first ball bearing 33*e* having the outer race 33*be*, whose outside diameter is slightly greater than the outside diameter of the outer race 33*b* of the initially-installed first ball bearing 33, is selected. Conversely, in the case that the clearance C2, measured with the initially-installed first ball bearing 33, is less than the allowable clearance range Q (i.e., C2<10 μm), another first ball bearing 33*e* having the outer race 33*be*, whose outside diameter is slightly less than the outside diameter of the outer race 33*b* of the initially-installed first ball bearing 33, is selected. By simply exchanging the initially-installed first ball hearing 33 with the properly-selected first ball bearing 33*e* having the outer race 33*be* whose outside diameter differs from the outside diameter of the outer race 33*b* of the initially-installed first ball bearing 33, the clearance-C2-adjustment can be achieved (see FIG. 14C). Thereafter, the left-hand side opening 41*b* of comb-tooth-shaped protruding portion 41*a* of cage 41 is closed by the plate 6 and then the plate 6, the annular member 19, and the sprocket body 1*a* are fastened together with bolts 7. In this manner, one complete cycle of the clearance-C2-adjustment and assembling work terminates.

As discussed previously, according to the modified clearance-adjustment procedures of speed reducer 8 shown in FIGS. 13 and 14A-14C, considerably severe very small clearance adjustment of speed reducer 8 is performed by adjusting the clearance C2 between the circumference of outer race 33*b* and the circumference of reference roller 34*a* under the condition where reference roller 34*a* is installed and deeply engaged in the space defined between (i) the inner face 19*b* of the trough of two adjacent internal teeth 19*a*, 19*a* and (ii) the outer race 33*b* of the certain first ball bearing 33, positioned in close proximity to each other in the radial direction (in other words, in an eccentric direction of the eccentric rotation member (30, 33) whose geometric center "Y" is displaced from the rotation center "X" of motor output shaft 13), and assembled through the left-hand side opening 41*b* of comb-tooth-shaped protruding portion 41*a* of cage 41. Hence, the modified clearance-C2-adjustment procedures of speed reducer 8 of the motor-driven phase-converter equipped variable valve actuation apparatus of the second embodiment shown in FIGS. 13 and 14A-14C can provide the same effects as the clearance-C1-adjustment procedures of speed reducer 8 of the motor-driven phase-converter equipped variable valve actuation apparatus of the first embodiment shown in FIGS. 7 and 8A-8B. That is, also in the modified clearance-C2-adjustment procedures of speed reducer 8 shown in FIGS. 13 and 14A-14C, it is possible to effectively reduce noise/vibrations arising from alternating torque transmitted from camshaft 2 to the VTC device and also to ensure the good control responsiveness of the VTC device, during operation of the VTC device.

According to the clearance-C2-adjustment procedures of FIG. 13, a plurality of first ball bearings, whose outer-race sizes (outer-race outside diameters) differ from each other, have been manufactured and prepared beforehand. When assembling component parts of the motor-driven phase-converter equipped variable valve actuation apparatus, in accordance with the procedures for adjusting very small clearance C2 as previously discussed in reference to the flowchart of FIG. 13, it is possible to certainly adjust an error of very small clearance C2 to an allowable value, that is, $10\ \mu m \leq C2 \leq 40\ \mu m$, by simply exchanging a certain first ball bearing 33 (that is, an initially-installed first ball bearing 33) of the plurality of first ball bearings with another first ball bearing 33*e*. By way of precise and easy speed-reducer clearance-C2-adjustment, it is possible to adequately suppress manufacturing costs from undesirably increase.

[Operation and Effects Common to First and Second Embodiments]

The operation and effects common to the first and second embodiments are hereunder described in detail.

In the shown embodiments, cover member 3 is made of synthetic resin material. Thus, it is possible to lighten the total weight of the engine, and also it is easy to integrally connect slip rings 48*a*-48*b* and connector terminal 49*a* with cover member 3, thus facilitating manufacturing and assembling work.

As viewed in the radial direction, the first ball bearing 33 is laid out to overlap with the needle bearing 28 over almost the entire inner peripheral face of the inner race 33*a* of the first ball bearing 33. Especially, as viewed in the radial direction, the annular member 19 and rollers 34 are laid out within almost the same axial position of needle bearing 28. Thus, it is possible to adequately shorten the axial length of the variable valve actuation apparatus (the VTC device). As a result, it is possible to realize downsizing and light weight of the VTC device.

Additionally, the structure of speed reducer 8 is simplified, thus facilitating manufacturing and assembling work, and also adequately suppressing or reducing manufacturing costs.

Also, the needle bearing 28 is laid out in a direction that is radially inwards from the deeply meshed-engagement position, at which roller 34 is brought into deeply meshed-engagement with the inner face 19*b* of the waveform internal toothed portion 19*a* of annular member 19. Thus, a heavy load transferred radially inwards from annular member 19 can be satisfactorily supported or received by the needle bearing 28. Hence, there is a decreased tendency for a bending moment, produced by the heavy load, to be imposed on the motor output shaft 13. This ensures a smoother rotary motion of motor output shaft 13 during operation of the VTC device.

Furthermore, lubricating oil can be constantly forcibly fed to the speed reducer 8 (in particular, the needle bearing 28, the first ball bearing 33, internal teeth 19*a* of annular member (inner peripheral meshing member) 19, rollers 34, and the axially-protruding lugs 41*a* of cage 41) by lubricating-oil supply/exhaust means (i.e., annular oil supply passage 45, axial oil supply hole 46, oil groove 46*a*, axial oil supply hole 46*b*, and oil exhaust holes). This ensures the enhanced lubrication performance for each component parts of speed reducer 8. More concretely, by the provision of lubricating-oil supply/exhaust means, lubricating oil can be constantly sufficiently fed into the spaces between respective rollers 34 and the waveform internal toothed portion 19*a* of annular member 19, the first ball bearing 33, and needle bearing 28, thus ensuring enhanced lubrication performance for needle rollers 28*b* of needle bearing 28, rollers 34, and balls of the first ball bearing 33. This ensures a smoother phase change accomplished by the speed reducer 8 always during operation of the VTC device. Additionally, the supplied lubricating oil also serves to absorb or cushion shocks (suddenly imposed loads) between the bearings and rollers and moving component parts of the speed reducer of the VTC device. Thus, it is possible to more effectively suppress or reduce the occurrence of hammering noise during operation of the speed reducer, thus extending the life of the VTC device.

In particular, when the engine is running, lubricating oil, pressurized by and discharged from the oil pump, is constantly fed via the lubricating-oil supply means to speed reducer 8 such that speed reducer 8 is sufficiently immersed in the lubricating oil, thus enabling a film of lubricating oil to be continuously interposed between the bearings and rollers and moving component parts of the speed reducer. Hence, it is possible to adequately reduce an initial driving load during the early stages of start-up of electric motor 12, thus balancing two contradictory requirements, namely, the high control responsiveness of the VTC device and the reduction in energy consumed.

Additionally, lubricating oil, exhausted from speed reducer 8 via the oil exhaust holes to the exterior space, tends to adhere to the second ball bearing 43 by a centrifugal force and also tends to adhere to the timing gear 1*b* of timing sprocket 1, thus ensuring effective, proper lubrication for these component parts.

Furthermore, motor output shaft 13 and eccentric shaft portion 30, formed integral with each other, are supported on the cam bolt 10 via the needle bearing 28 and the third ball bearing 35. This eliminates the necessity of providing an additional supporting shaft, thus reducing the number of component parts. Also, as can be seen from the cross section of FIG. 1, the motor output shaft 13, formed integral with the eccentric shaft portion 30, is installed and directly connected through the driven member 9 onto the front end of camshaft 2 in a direction that is axially rightward, thus suppressing a radial inclination of motor output shaft 13 and ensuring a high coaxiality of motor output shaft 13 with respect to the axis of camshaft 2.

By the provision of housing 5, speed reducer 8 and electric motor 12 are united each other. Additionally, via the sprocket body 1*a*, more precisely, by axially fastening three members, namely, plate 6, annular member 19, and sprocket body 1*a* together with bolts 7, speed reducer 8, electric motor 12, and timing sprocket 1 are integrally connected to each other. That is, according to the improved cross-sectional configuration of the motor-driven phase-converter equipped variable valve actuation apparatus of the embodiment, a plurality of component parts can be united each other. Thus, it is possible to downsize the radial dimension as well as the axial dimension of the apparatus. The compactly-united component parts facilitate product management.

Also, the second oil seal 32 is kept in elastic-contact with the outer periphery of the cylindrical-hollow motor output shaft 13, so as to apply a frictional resistance to rotation of motor output shaft 13. Thus, the second oil seal 32 also serves to absorb alternating torque exerted on camshaft 2 owing to the spring bias of each of valve springs, thus effectively suppressing a load imposed on the electric motor 12 due to the alternating torque.

Moreover, motor output shaft 13 and eccentric shaft portion 30 are formed integral with each other. In comparison with a device that a motor output shaft and an eccentric shaft portion are formed separately from each other, the integral construction of motor output shaft 13 and eccentric shaft portion 30 contributes to reduced number of component parts and easy manufacturing and assembling work, thus reducing manufacturing costs.

As will be appreciated from the above, the present invention is not limited to each of the first and second embodiments shown and described herein. Various changes and modifications may be made. As previously described, according to the first embodiment, clearance-C1-adjustment is performed by exchanging the reference roller set with a different-size roller set that ensures the allowable clearance range (i.e., 10 μm-40 μm), only when the actually-measured clearance C1 is out of the allowable clearance range, that is, C1<10 μm or 40 μm<C1. On the other hand, according to the second embodiment, clearance-C2-adjustment is performed by exchanging a certain first ball bearing 33 (an initially-installed first ball bearing 33), which was installed first, with a different-outer-race-size first ball bearing that ensures the allowable clearance range (i.e., 10 μm-40 μm), only when the actually-measured clearance C2 is out of the allowable clearance range, that is, C2<10 μm or 40 μm<C2. In lieu thereof, as a modification, in order to adjust a very small clearance of speed reducer 8, a plurality of annular members 19, whose waveform-internal-toothed-portion inside diameters differ from each other, have been manufactured and prepared beforehand. When assembling component parts of the motor-driven phase-converter equipped variable valve actuation apparatus, a specified one of the plurality of annular members 19 may be selected such that clearance C1 between roller 34 and the circumference of the inner face 19*b* of the waveform internal toothed portion 19*a* can be adjusted within the allowable clearance range Q, that is, 10 μm≤C1≤40 μm. It will be understood that, for easy but fine adjustment of a very small clearance of speed reducer 8, either one of component parts (i.e., eccentric rotation member (30, 33), annular member 19 and a roller set 34), related to the radial clearance (C1; C2) of speed reducer 8, may be reinstalled, fully taking into account the measured clearance C1 and/or the measured clearance C2, thereby more certainly ensuring smooth rolling motion of each of the rolling elements (rollers 34), reduced noise and vibrations of the whole VTC device, and the enhanced control responsiveness of the VTC device.

In the shown embodiments, rollers 34 (or reference rollers 34*a*) are used as rolling elements, guided by respective axially-protruding lugs 41*a* of cage 41. Instead of using rollers 34 as rolling elements, steel balls may be used as rolling elements.

The variable valve actuation apparatus of the shown embodiments is exemplified in a variable valve timing control (VTC) device (a variable cam phase control device). Alternatively, the fundamental concept of the present invention may be applied to a continuously variable valve event and lift control (VEL) device (or a variable working-angle and lift control device) as described in Japanese Patent Provisional Publication No. 2010-84716 (hereinafter referred to as "JP2010-084716") assigned to the assignee of the present invention. In the case of the VEL device as described in JP2010-084716, to vary the valve operating characteristic (working angle and valve lift), a control shaft, which has an eccentric cam integrally formed on its outer periphery, is rotated by an actuator. The angular position of the eccentric cam, whose geometric center is displaced from the axis of the control shaft, changes by rotary motion of the control shaft driven by the actuator. As a result, a change in the angular position of the eccentric cam is transferred via a multi-nodular linkage (a motion converter) to rockable cams associated with respective engine valves. In this manner, an initial attitude of each of the rockable cams can be changed so as to variably adjust the valve operating characteristic (working angle and valve lift). The actuator is comprised of an electric motor and a speed reducer, both accommodated in the same housing (or the same motor cover). The electric motor and the speed reducer, accommodated in the housing, are produced as a motor-and-speed-reducer unit. The housing is fixedly connected to an engine body (e.g., an engine block). On the other hand, an output from the motor-and-speed-reducer unit is transmitted via a driven member to the control shaft. Thus, assuming that the fundamental concept of the present invention can applied to the VEL device as described in JP2010-084716, the housing (the motor cover) serves as a first member, whereas the driven member of the speed reducer serves as a second member. In order to effectively reduce noise and vibrations of the VEL device, and also to enhance the control responsiveness of the VEL device, considerably severe clearance adjustment of the speed reducer can be accomplished by the same clearance-adjustment procedures as previously described in reference to the flowcharts of FIGS. 7 and 13.

Also, the first and second embodiments can provide the following further operation and effects.

Each of the rolling elements of speed reducer 8 is a cylindrical solid roller 34, interleaved between the outer periphery of the eccentric rotation member (30, 33) and the waveform internal toothed portion 19*a* of the annular member (the inner peripheral meshing member 19), while being held in rolling-contact with the outer peripheral surface of the eccentric rotation member. Thus, the roller of this type can provide a stable, smooth rolling motion.

Furthermore, the cage 41, configured to hold the rolling elements (i.e., rollers 34), while circumferentially partitioning the rolling elements by the respective lugs 41*a*, has the opening 41*b* that permits each of the rolling elements to fall out from one axial end of the cage. Also, the plate 6 is detachably installed on one of the first and second members, namely, timing sprocket 1 and camshaft 2 (or driven member 9), for closing the one axial end of the cage 41 and preventing the rolling elements from falling out. By removing the plate 6 as needed, it is possible to easily replace the rolling elements (rollers 34) with another rolling-element set, via the opening 41*b*. For instance, when considerably severe clearance management has to be carried out again by replacement owing to an excessive wear in each of the rolling elements or an initial deviation of the radial clearance (C1; C2) from the allowable clearance range, such replacement can be easily made by removing the plate 6.

Also, the plate 6 is fixedly connected to the inner peripheral meshing member (annular member 19) by fastening them together with a fastener (bolts 7). By removing or installing the detachable plate 6, the rolling elements (rollers 34) can be easily replaced via the opening 41*b*, thus ensuring easy maintenance of speed reducer 8.

Moreover, the eccentric rotation member (30, 33) comprises an eccentric shaft portion 30, to which the torque is transmitted directly from the electric motor 12, and a bearing 33 installed on the outer periphery of the eccentric shaft portion 30, and an oil seal 32 is installed on the inner peripheral surface of the plate 6 and kept in sliding-contact with the outer peripheral surface of the motor output shaft 13 in close proximity to the eccentric shaft portion 30, and also lubricating oil is fed toward the rolling elements (rollers 34), arranged on a side of the oil seal 32, facing toward the one axial end of the cage 41. Thus, the oil seal 32 serves to suppress or prevent lubricating oil from flowing into the electric motor 12, and also serves to permit positive lubricating-oil supply to each of the rolling elements (rollers 34), thereby enhancing the lubrication performance, that is, a smoother change of angular phase of camshaft 2 relative to timing sprocket 1.

The electric motor 12 is arranged on the opposite side of the oil seal 32, facing apart from the one axial end of the cage 41. Thus, it is possible to suppress or prevent a leakage of lubricating oil, fed to the rolling elements (rollers 34), toward the electric motor 12.

Also, the electric motor 12 has a rotor 17 fixedly connected onto the outer peripheral surface of the motor output shaft 13, and the motor output shaft 13 and the eccentric shaft portion 30 are formed integral with each other. That is, motor output shaft 13 and eccentric shaft portion 30, integrally formed as a unit, facilitates manufacturing and assembling work, thus enhancing parts control.

Additionally, the electric motor 12 is a direct-current motor comprising at least one permanent magnet 14-15 fixedly connected onto the inner peripheral surface of the housing 5, the motor output shaft 13 rotatably supported in the housing 5, an electromagnetic coil 18 wound on the outer periphery of the rotor 17, and a current-supply to the electromagnetic coil 18 is performed through at least one feeder brush 23*a*-23*b*. The brush-equipped electric motor contributes to lower manufacturing costs.

The entire contents of Japanese Patent Application No. 2010-103385 (filed Apr. 28, 2010) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable valve actuation apparatus of an internal combustion engine configured to vary an operating characteristic of an engine valve permanently biased in a direction closing of the engine valve by a valve spring, by changing an angular position of a second member relative to a first member, comprising:

an electric motor in which a state of rotation of the electric motor is controlled responsively to a control signal;

an eccentric rotation member configured to rotate eccentrically with respect to a center of rotation of an output shaft of the electric motor by torque transmitted from the electric motor;

an inner peripheral meshing member integrally connected to one of the first and second members and having an internal toothed portion formed on its inner periphery;

a plurality of rolling elements rotatably installed on an outer peripheral surface of the eccentric rotation member and circumferentially arranged substantially at regular intervals, and configured such that a meshing point of the plurality of rolling elements with the inner peripheral meshing member circumferentially shifts by eccentric rotary motion of the eccentric rotation member; and a cage integrally connected to the other member of the first and second members and having a plurality of lugs for circumferentially partitioning the respective rolling elements, while permitting a radial displacement of each of the rolling elements, wherein, depending on a dimension of a clearance space between the outer peripheral surface of the eccentric rotation member and the inner peripheral meshing member, either one of a plurality of rolling-element sets, each having a different rolling-element outside diameter, is selected, and then the rolling elements of the selected rolling-element set are installed on the outer peripheral surface of the eccentric rotation member, and wherein either one of a radial clearance C1 between an outer peripheral surface of a specified one of the rolling elements, interleaved and deeply engaged in a space defined between the outer e periheral surface of the eccentric rotation member and an inner face of the internal toothed portion of the inner peripheral meshing member, positioned in an eccentric direction of the eccentric rotation member whose geometric center is displaced from the center of rotation of the motor output shaft and the inner face of the internal toothed portion of the inner peripheral meshing member and a radial clearance C2 between the outer peripheral surface of the specified one of the rolling elements, interleaved and deeply engaged in the space defined between the outer peripheral surface of the eccentric rotation member and the inner face of the internal toothed portion of the inner peripheral meshing member, positioned in the eccentric direction of the eccentric rotation member and the outer peripheral surface of the eccentric rotation member, is set to a given clearance, ranging from 10 μm to 40 μm.

2. The variable valve actuation apparatus as claimed in claim 1, wherein:

each of the rolling elements is a cylindrical solid roller.

3. The variable valve actuation apparatus as claimed in claim 1, wherein:

the one of the first and second members is fixedly connected to a rotating part to which torque is transmitted from a crankshaft of the engine, whereas the other member is fixedly connected to a camshaft; and open timing and closure timing of the engine valve are varied by changing an angular phase of the second member relative to the first member.

4. The variable valve actuation apparatus as claimed in claim 1, wherein:

the cage, configured to hold the rolling elements, while circumferentially partitioning the rolling elements by the respective lugs, has an opening that permits each of the rolling elements to fall out from one axial end of the cage; and a plate is detachably installed on one of the first and second members for closing the one axial end of the cage and preventing the rolling elements from falling out.

5. The variable valve actuation apparatus as claimed in claim 4, wherein:

the plate is fixedly connected to the inner peripheral meshing member by fastening them together with a fastener.

6. The variable valve actuation apparatus as claimed in claim 5, wherein:

the eccentric rotation member comprises an eccentric shaft portion, to which the torque is transmitted directly from the electric motor, and a bearing installed on an outer periphery of the eccentric shaft portion;

an oil seal is installed on an inner peripheral surface of the plate and kept in sliding-contact with the outer peripheral surface of the motor output shaft in close proximity to the eccentric shaft portion; and lubricating oil is fed toward the rolling elements, arranged on a side of the oil seal, facing toward the one axial end of the cage.

7. The variable valve actuation apparatus as claimed in claim 6, wherein:

the electric motor is arranged on the opposite side of the oil seal, facing apart from the one axial end of the cage.

8. The variable valve actuation apparatus as claimed in claim 7, wherein:

the electric motor has a rotor fixedly connected onto the outer peripheral surface of the motor output shaft; and the motor output shaft and the eccentric shaft portion are formed integral with each other.

9. The variable valve actuation apparatus as claimed in claim 8, wherein:

the electric motor is a direct-current motor comprising at least one permanent magnet fixedly connected onto an inner peripheral surface of a housing, the motor output shaft rotatably supported in the housing, an electromagnetic coil wound on an outer periphery of the rotor;

a current-supply to the electromagnetic coil is performed through at least one feeder brush.

10. A variable valve actuation apparatus of an internal combustion engine configured to vary an operating characteristic of an engine valve permanently biased in a direction closing of the engine valve by a valve spring, by changing an angular position of a second member relative to a first member, comprising:

an electric motor in which a state of rotation of the electric motor is controlled responsively to a control signal;

an eccentric rotation member configured to rotate eccentrically with respect to a center of rotation of an output shaft of the electric motor by torque transmitted from the electric motor;

an inner peripheral meshing member integrally connected to one of the first and second members and having an internal toothed portion formed on its inner periphery;

a plurality of rolling elements rotatably installed on an outer peripheral surface of the eccentric rotation member and circumferentially arranged substantially at regular intervals, and configured such that a meshing point of the plurality of rolling elements with the inner peripheral meshing member circumferentially shifts by eccentric rotary motion of the eccentric rotation member; and a cage integrally connected to the other member of the first and second members and having a plurality of lugs for circumferentially partitioning the respective rolling elements, while permitting a radial displacement of each of the rolling elements, wherein, depending on a dimension of a clearance space between the outer peripheral surface of the eccentric rotation member and the inner peripheral meshing member, either one of a plurality of eccentric rotation members, each having a different outside diameter, is selectively installed, and wherein either one of a radial clearance C1 between an outer peripheral surface of a specified one of the rolling elements, interleaved and deeply engaged in a space defined between the outer peripheral surface of the eccentric rotation member and an inner face of the internal toothed portion of the inner peripheral meshing member, positioned in an eccentric direction of the eccentric rotation member whose geometric center is displaced from the center of rotation of the motor output shaft and the inner face of the internal toothed portion of the inner peripheral meshing member and a radial clearance C2 between the outer peripheral surface of the specified one of the rolling elements, interleaved and deeply engaged in the space defined between the outer peripheral surface of the eccentric rotation member and the inner face of the internal toothed portion of the inner peripheral meshing member, positioned in the eccentric direction of the eccentric rotation member and the outer peripheral surface of the eccentric rotation member, is set to a given clearance, ranging from 10 μm to 40μm.

11. The variable valve actuation apparatus as claimed in claim 10, wherein:

the electric motor is a brush-equipped motor in which a current-supply to an electromagnetic coil is performed through at least one feeder brush.

12. The variable valve actuation apparatus as claimed in claim 10, wherein:

the eccentric rotation member comprises an eccentric shaft portion, to which the torque is transmitted from the electric motor, and a rotatable member installed on an outer periphery of the eccentric shaft portion such that the rolling elements are held in rolling-contact with an outer peripheral surface of the rotatable member; and depending on a dimension of a clearance space between the outer peripheral surface of the rotatable member and the inner peripheral meshing member, either one of a plurality of rotatable members, each having a different outside diameter, is selectively installed.

13. The variable valve actuation apparatus as claimed in claim 12, wherein:

the rotatable member is a ball bearing comprising inner and outer races and balls confined between the inner and outer races;

the inner race of the ball bearing is press-fitted onto the outer periphery of the eccentric shaft portion, whose geometric center is displaced from the center of rotation of the motor output shaft; and depending on a dimension of a clearance space between an outer peripheral surface of the outer race of the ball bearing and the inner peripheral meshing member, either one of a plurality of ball bearings, whose outer-race outside diameters differ from each other, is selectively installed.

14. A method of manufacturing a variable valve actuation apparatus of an internal combustion engine configured to vary an operating characteristic of an engine valve permanently biased in a direction closing of the engine valve by a valve spring, by changing an angular position of a second member relative to a first member via a speed reducer, said speed reducer including an eccentric rotation member configured to rotate eccentrically with respect to a center of rotation of an output shaft of an electric motor by torque transmitted from the electric motor, an inner peripheral meshing member integrally connected to one of the first and second members and having an internal toothed portion formed on its inner periphery, a plurality of rolling elements rotatably installed on an outer peripheral surface of the eccentric rotation member and circumferentially arranged substantially at regular intervals, and configured such that a meshing point of the plurality of rolling elements with the inner peripheral meshing member circumferentially shifts by eccentric rotary motion of the eccentric rotation member, and a cage integrally connected to the other member of the first and second members and having a plurality of lugs for circumferentially partitioning the respective rolling elements, while permitting a radial displacement of each of the rolling elements, comprising:

installing the rolling elements, each having a reference outside diameter, into respective spaces partitioned by the lugs of the cage arranged between the outer peripheral surface of the eccentric rotation member and the inner peripheral meshing member;

measuring, under a state where the rolling elements, each having the reference outside diameter, have been installed, either one of a radial clearance C1 between an outer peripheral surface of a specified one of the rolling elements, interleaved and deeply engaged in a space defined between the outer peripheral surface of the eccentric rotation member and an inner face of the internal toothed portion of the inner peripheral meshing member, positioned in an eccentric direction of the eccentric rotation member whose geometric center is displaced from the center of rotation of the motor output shaft and the inner face of the internal toothed portion of the inner peripheral meshing member and a radial clearance C2 between the outer peripheral surface of the specified one of the rolling elements, interleaved and deeply engaged in the space defined between the outer peripheral surface of the eccentric rotation member and the inner face of the internal toothed portion of the inner peripheral meshing member, positioned in the eccentric direction of the eccentric rotation member and the outer peripheral surface of the eccentric rotation member;

determining, based on a measurement result of the radial clearance, which of a plurality of rolling-element sets, each having a different rolling-element outside diameter, should be selected as a rolling-element set suitable for the measured radial clearance; and reinstalling the rolling elements of the suitably-selected rolling-element set into the respective spaces partitioned by the lugs of the cage, only when the rolling elements, each having the reference outside diameter, are unsuitable for the measured radial clearance.

15. The method as claimed in claim 14, wherein:

the one of the first and second members is fixedly connected to a rotating part to which torque is transmitted from a crankshaft of the engine, whereas the other member is fixedly connected to a camshaft; and open timing and closure timing of the engine valve are varied by changing an angular phase of the second member relative to the first member.

16. A method of manufacturing a variable valve actuation apparatus of an internal combustion engine configured to vary an operating characteristic of an engine valve permanently biased in a direction closing of the engine valve by a valve spring, by changing an angular position of a second member relative to a first member via a speed reducer, said speed reducer including an eccentric rotation member configured to rotate eccentrically with respect to a center of rotation of an output shaft of an electric motor by torque transmitted from the electric motor, an inner peripheral meshing member integrally connected to one of the first and second members and having an internal toothed portion formed on its inner periphery, a plurality of rolling elements rotatably installed on an outer peripheral surface of the eccentric rotation member and circumferentially arranged substantially at regular intervals, and configured such that a meshing point of the plurality of rolling elements with the inner peripheral meshing member circumferentially shifts by eccentric rotary motion of the eccentric rotation member, and a cage integrally connected to the other member of the first and second members and having a plurality of lugs for circumferentially partitioning the respective rolling elements, while permitting a radial displacement of each of the rolling elements, comprising:

installing the rolling elements into respective spaces partitioned by the lugs of the cage arranged between the outer peripheral surface of the eccentric rotation member having a reference outside diameter and the inner peripheral meshing member;

measuring, under a state where the rolling elements have been installed, either one of a radial clearance C1 between an outer peripheral surface of a specified one of the rolling elements, interleaved and deeply engaged in a space defined between the outer peripheral surface of the eccentric rotation member and an inner face of the internal toothed portion of the inner peripheral meshing member, positioned in an eccentric direction of the eccentric rotation member whose geometric center is displaced from the center of rotation of the motor output shaft and the inner face of the internal toothed portion of the inner peripheral meshing member and a radial clearance C2 between the outer peripheral surface of the specified one of the rolling elements, interleaved and deeply engaged in the space defined between the outer peripheral surface of the eccentric rotation member and the inner face of the internal toothed portion of the inner peripheral meshing member, positioned in the eccentric direction of the eccentric rotation member and the outer peripheral surface of the eccentric rotation member;

determining, based on a measurement result of the radial clearance, which of a plurality of eccentric rotation members, each having a different outside diameter, should be selected as an eccentric rotation member suitable for the measured radial clearance; and reinstalling the suitably-selected eccentric rotation member, only when the eccentric rotation member having the reference outside diameter is unsuitable for the measured radial clearance.

* * * * *